US010448463B2

(12) United States Patent
De Angelis

(10) Patent No.: US 10,448,463 B2
(45) Date of Patent: Oct. 15, 2019

(54) INDUCTION HEATING METHOD AND SYSTEM

(71) Applicant: ELECTROLUX APPLIANCES AKTIEBOLAG, Stockholm (SE)

(72) Inventor: Andrea De Angelis, Porcia (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 26 days.

(21) Appl. No.: 15/764,952

(22) PCT Filed: Sep. 30, 2016

(86) PCT No.: PCT/EP2016/073391
§ 371 (c)(1),
(2) Date: Mar. 30, 2018

(87) PCT Pub. No.: WO2017/055528
PCT Pub. Date: Apr. 6, 2017

(65) Prior Publication Data

US 2018/0279423 A1 Sep. 27, 2018

(30) Foreign Application Priority Data

Oct. 2, 2015 (EP) ..... 15188158

(51) Int. Cl.
*H05B 6/04* (2006.01)
*H05B 6/06* (2006.01)
*H05B 6/12* (2006.01)

(52) U.S. Cl.
CPC ..... *H05B 6/065* (2013.01); *H05B 6/04* (2013.01); *H05B 6/06* (2013.01); *H05B 2213/05* (2013.01); *H05B 2213/07* (2013.01)

(58) Field of Classification Search
CPC . H05B 6/04; H05B 6/06; H05B 6/062; H05B 6/065; H05B 6/1254; H05B 6/1263; H05B 2213/05; H05B 2213/07
(Continued)

(56) References Cited

U.S. PATENT DOCUMENTS 3,887,781 A * 6/1975 Peters, Jr. ..... F24C 7/02 219/667
4,151,387 A * 4/1979 Peters, Jr. ..... F24C 7/02 219/626
2003/0155349 A1 8/2003 Matsuo et al.

FOREIGN PATENT DOCUMENTS

EP 0460279 A2 12/1991
GB 2085243 A 4/1982
WO 2013064332 A1 5/2013

OTHER PUBLICATIONS

International Search Report and Written Opinion issued in corresponding PCT application No. PCT/EP2016/073391 dated Jan. 3, 2017, 8 pages.

* cited by examiner

*Primary Examiner* — Hung D Nguyen
(74) *Attorney, Agent, or Firm* — Pearne & Gordon LLP

(57) ABSTRACT

An induction heating system is disclosed. The system has an electrically conducting load and an inverter circuit with a switching section and a resonant section, wherein the switching section can generate an AC current from an AC input voltage incorporating a plurality of half-waves. The resonant section has an induction heating coil adapted to receive the AC current for generating a corresponding time-varying magnetic field in order to generate heat in the electrically conducting load by inductive coupling. The amount of heat generated in the load depends on the electric power delivered to the load through the induction heating
(Continued)

coil, which depends on the frequency of the AC current. A method for managing an induction heating system also is disclosed.

23 Claims, 12 Drawing Sheets

(58) Field of Classification Search
USPC ..... 219/620, 622, 624, 625, 626, 635, 219/660–668, 670–672, 675
See application file for complete search history.

INDUCTION HEATING METHOD AND SYSTEM

BACKGROUND OF THE INVENTION

Field of the Invention

The present invention generally relates to the field of induction heating. More specifically, the present invention relates to inverters for induction heating apparatuses.

Overview of the Related Art

Induction heating is a well-known method for heating an electrically conducting load by inducing eddy currents in the load through a time-varying magnetic field generated by an alternating current (hereinafter, simply AC current) flowing in an induction heating coil. The internal resistance of the load causes the induced eddy currents to generate heat in the load itself.

Induction heating is used in several applications, such as in the induction cooking field, wherein induction heating coils are located under a cooking hob surface for heating cooking pans made (or including portions) of electrically ferromagnetic material placed on the cooking hob surface, or in the ironing field, wherein induction heating coils are located under the main surface of an ironing board for heating an electrically conducting plate of a iron configured to transfer heat to clothes when the iron travels over the ironing board (similar considerations apply to a pressure iron system).

The amount of heat generated in the load depends on the electric power delivered to the load through the induction heating coil, which in turn depends on the frequency of the AC current flowing through the latter, the coupling between the load and the induction heating coil, and the time spent by the load at the induction heating coil.

Usually, the AC current used to generate the time-varying magnetic field is generated by means of an inverter circuit, such as a half bridge inverter, a full bridge inverter, or a quasi-resonant inverter, comprising a switching section including power switching elements, such as for example Insulated-Gate Bipolar Transistors (IGBT), and a resonant section comprising inductor(s) and capacitor(s), with the induction heating coil that is an inductor of the latter section. The inverter circuit is configured to receive an input alternating voltage (hereinafter, simply AC voltage), such as the mains voltage taken from the power grid, and to accordingly generate an AC current (flowing through the induction heating coil) oscillating at a frequency corresponding to actuation frequency of the power switching elements (i.e., the frequency with which they are switched between the on and the off state) and having an envelope following the input AC voltage, with the amplitude of the envelope that depends in turn on the actuation frequency itself (the lower the actuation frequency, the higher the amplitude thereof). The current flowing through the induction heating coil is sourced/drained by the power switching elements of the switching section.

As already mentioned above, the electric power delivered to the load through the induction heating coil depends on the frequency of the AC current flowing through the latter. With an inverter circuit of the type described above, the electric power provided to the load is at its maximum when the current flowing through the induction heating coil oscillates at the resonance frequency of the resonant section, i.e., when the actuation frequency is equal to the resonance frequency.

For actuation frequencies lower than resonance frequency, the power switching elements may be irreparably damaged because of heat dissipation, and control instability due to loss of soft switching conditions.

As it is well known to those skilled in the art the electric power delivered to the load (and the resonance frequency as well), strongly depends on the coupling between the induction heating coil and the load, i.e., it depends from a series of unpredictable features such as the type of load, the distance between load and induction heating coil, the geometry of the load and of the induction heating coil. In other words, because of these unpredictable features, it is not possible to known any a priori relation between the actuation frequency and the electric power delivered to the load, since said relation would change as at least one of said unpredictable features changes.

For this reason, devices which exploit induction heating should be provided with a control unit specifically designed to carry out dynamic measurements so as to obtain an indication about how the actuation frequency and the electric power delivered to the load are related to each other. When a user of a device of this kind is requesting a specific electric power (e.g., corresponding to a specific temperature to be reached by a cooking pan or by a clothes iron), such control unit has to carry out measurements to assess the actuation frequency/electric power relation corresponding to the actual condition (e.g., corresponding to the actual coupling between the induction heating coil and the load); then, the control unit is configured to dispense the requested electric power by setting the actuation frequency according to the assessed actuation frequency/electric power relation. If the exact request of the user cannot be satisfied because according to the assessed relation the requested electric power corresponds to an unfeasible actuation frequency (e.g., lower than the resonance frequency), the control unit may be configured to set the electric power to a safe level different from the requested one.

EP1734789 discloses a method involving providing an alternating supply voltage and a frequency converter with an adjustable switching unit. The operating frequency of the switching unit and/or the frequency converter is increased from a frequency base in the course of half cycle of the voltage. The frequency is then decreased to the base, so that the frequency amounts to the base, at the zero crossing of the supply voltage.

SUMMARY OF INVENTION

Applicant has observed that an induction heating system should be provided with a control unit having the capability of rapidly obtaining an indication about how the actuation frequency and the electric power delivered to the load are related to each other in the actual condition (e.g., corresponding to the actual coupling between the induction heating coil and the load) and dispensing the requested electric power by setting the actuation frequency according to the assessed actuation frequency/electric power relation.

The aim of the present invention is therefore to provide a method for managing an induction heating system, and to provide a corresponding induction heating system, which allows to dynamically delivery electric power to a load in a fast way, and which is able to rapidly respond to variations affecting the coupling between the induction heating coil(s) and the load.

An aspect of the present invention proposes a method for managing an induction heating system. The induction heating system comprises an electrically conducting load and an inverter circuit. The inverter circuit comprises a switching section and a resonant section. The switching section comprises switching devices adapted to generate an AC current from an AC input voltage comprising a plurality of half-waves. The resonant section comprises an induction heating coil adapted to receive the AC current for generating a corresponding time-varying magnetic field in order to generate heat in the electrically conducting load by inductive coupling. The AC current oscillates at an actuation frequency of the switching devices and has an envelope comprising a plurality of half-waves corresponding to the half-waves of the AC input voltage. The amount of heat generated in the load depends on the electric power delivered to the load through the induction heating coil, such delivered electric power depending in turn on the frequency of the AC current. The method comprises performing at least once the following sequence of phases a)-g):

a) receiving an indication about a target electric power value to be delivered to the load;

b) varying, within a same half-wave of the envelope, the actuation frequency according to a sequence of actuation frequency values, each actuation frequency value of the sequence being set for a corresponding time interval corresponding to a fraction of the duration of the half-wave of the envelope;

c) for each actuation frequency value of the sequence, calculating a corresponding current peak value based on a corresponding set of at least one absolute value peak assumed by the AC current during the corresponding time interval, so as to generate a corresponding current peak/actuation frequency relation;

d) generating an electric power/current peak relation, said electric power/current peak relation depicting how the delivered electric power varies as a function of the current peak of the AC current;

e) selecting a current peak value corresponding to the target electric power exploiting said electric power/current peak relation;

f) selecting an actuation frequency value corresponding to the selected current peak value exploiting said current peak/actuation frequency relation;

g) setting the actuation frequency based on said selected actuation frequency value.

According to an embodiment of the present invention, said generating an electric power/current peak relation comprises identifying at least one electric power/current peak value pair comprising an electric power value and a corresponding current peak value, in which said electric power value of the pair corresponds to an actual electric power delivered to the load at the corresponding current peak value of the same pair. Said generating an electric power/current peak relation further comprises selecting a function expressing a relation between electric power values and current peak values. Said identified at least one electric power/current peak value pair satisfies said function.

According to an embodiment of the present invention, said identifying at least one electric power/current peak value pair comprises exploiting an electric power/current peak value pair comprising the actual electric power delivered to the load corresponding to the actuation frequency which has been set at phase g) of a previous iteration of the sequence of operations a)-g).

According to an embodiment of the present invention, said function is a linear function or a quadratic function.

According to an embodiment of the present invention, said identifying at least one electric power/current peak value pair comprises identifying a first electric power/current peak value pair. Said identifying a first electric power/current peak value pair comprises: setting the actuation frequency to a first actuation frequency value for the duration of a further half-wave of the envelope; measuring the current peak value corresponding to highest absolute value assumed by the AC current during said further half-wave of the envelope; measuring the actual electric power delivered to the load at said measured current peak value during said further half-wave of the envelope; setting said first electric power/current peak value pair based on said current peak value and said actual electric power measured during said further half-wave of the envelope.

According to an embodiment of the present invention, said identifying at least one electric power/current peak value pair further comprises identifying a second electric power/current peak value pair. Said identifying a second electric power/current peak value pair comprises setting the actuation frequency to a second actuation frequency value different from the first actuation frequency value for the duration of a still further half-wave of the envelope; measuring the current peak value corresponding to highest absolute value assumed by the AC current during said still further half-wave of the envelope; measuring the actual electric power delivered to the load at said measured current peak value during said still further half-wave of the envelope; setting said second electric power/current peak value pair based on said current peak value and said actual electric power measured during said still further half-wave of the envelope.

According to an embodiment of the present invention, said first actuation frequency value is equal to or higher than a resonance frequency of the resonant section.

According to an embodiment of the present invention, said second actuation frequency value is equal to or lower than the highest actuation frequency the switching devices can safely sustain.

According to an embodiment of the present invention, said phase of calculating, for each actuation frequency value of the sequence, the corresponding current peak value comprises normalizing each one of the absolute value peaks of the corresponding set of at least one absolute value peak according to the position of the corresponding time interval with respect to said half-wave to obtain a corresponding set of at least one normalised current peak value, and then calculating the peak value based on the normalised current peak values of the set.

According to an embodiment of the present invention, if said set of at least one absolute value peak comprises at least two absolute value peaks, said calculating the peak value based on the normalised current peak values of the set comprising calculating an average value of said at least two absolute value peaks.

According to an embodiment of the present invention, the induction heating system comprises a group of at least two induction heating coils. The method comprises setting the actuation frequency for each induction heating coil of the group based on said selected actuation frequency value. Particularly, all coils within the same group may work at the same frequency. According to an embodiment the method of the present invention may comprise a step g) of setting the actuation frequency for each induction-heating coil of the group to a same value based on said selected actuation frequency value. In other words, the frequency of all coils of said group may be the same. However, alternatively it is also an embodiment of the present invention that a step g) of setting the actuation frequency for each induction-heating coil of the group may consider setting the actuation frequency for the induction-heating coil of the group two at least two different values. In other words, at least one, particularly more than one, of the induction-heating coil of the group may be set to a different value based on said selected actuation frequency value. Accordingly, also different working frequency may be used.

According to an embodiment of the present method, generating an electric power/current peak relation comprises identifying at least a global electric power/current peak value pair comprising a first global electric power value and a corresponding first global current peak value, in which said first global electric power value of the first pair corresponds to an actual electric power delivered to the load by the induction heating coils of the group when the AC current globally received by the induction heating coils of the group assumes a peak corresponding to said first global current peak value. Particularly, the method may further comprise selecting a function expressing a relation between electric power values and current peak values, wherein said identified at least one global electric power/current peak value pairs satisfy said function.

Particularly, a method according to the present invention may comprise identifying more than one, eg. a first and a second, global electric power/current peak value pair. This advantageously allows to use at least one, at least two, at least three, or more than three global electric power/current peak value pairs, and particularly measurements point.

Particularly, in a case where generating an electric power/current peak relation comprises identifying at least one electric power/current peak value pair comprising an electric power value and a corresponding current peak value, in which said electric power value of the pair corresponds to an actual electric power delivered to the load at the corresponding current peak value of the same pair and/or selecting a function expressing a relation between electric power values and current peak values, wherein said identified at least one electric power/current peak value pair satisfies said function, it is preferred that the method comprises identifying at least a first global electric power/current peak value pair comprising a first global electric power value and a corresponding first global current peak value, in which said first global electric power value of the first pair corresponds to an actual electric power delivered to the load by the induction heating coils of the group when the AC current globally received by the induction heating coils of the group assumes a peak corresponding to said first global current peak value. Moreover, the method preferably comprises identifying a second global electric power/current peak value pair comprising a second global electric power value and a corresponding second global current peak value, in which said second global electric power value of the second pair corresponds to an actual electric power delivered to the load by the induction heating coils of the group when the AC current globally received by the induction heating coils of the group assumes a peak corresponding to said second global current peak value. Additionally or alternatively the method according to the invention comprises selecting a function expressing a relation between electric power values and current peak values, wherein said identified first and second at least one global electric power/current peak value pairs satisfy said function.

According to an embodiment of the present invention, said generating an electric power/current peak relation comprises:

identifying a first global electric power/current peak value pair comprising a first global electric power value and a corresponding first global current peak value, in which said first global electric power value of the first pair corresponds to an actual electric power delivered to the load by the induction heating coils of the group when the AC current globally received by the induction heating coils of the group assumes a peak corresponding to said first global current peak value;

identifying a second global electric power/current peak value pair comprising a second global electric power value and a corresponding second global current peak value, in which said second global electric power value of the second pair corresponds to an actual electric power delivered to the load by the induction heating coils of the group when the AC current globally received by the induction heating coils of the group assumes a peak corresponding to said second global current peak value;

selecting a function expressing a relation between electric power values and current peak values, wherein said identified first and second global electric power/current peak value pairs satisfy said function.

According to an embodiment of the present invention, said identifying a first global electric power/current peak value pair comprises:

concurrently activating all the induction heating coils of the group by setting the actuation frequency to a first actuation frequency value for the duration of a further half-wave of the envelope;

for each induction heating coil of the group, measuring a corresponding first current peak value corresponding to the highest absolute value assumed by the AC current received by said induction heating coil during said further half-wave of the envelope, and measuring a corresponding first electric power delivered to the load by such induction heating coil during said further half-wave of the envelope;

setting said first global current peak value to the sum of said measured first current peak values, and setting said first global electric power value to the sum of said measured first electric powers.

According to an embodiment of the present invention, said identifying a second global electric power/current peak value pair comprises:

concurrently activating all the induction heating coils of the group by setting the actuation frequency to a second actuation frequency value different from the first actuation frequency value for the duration of a still further half-wave of the envelope;

for each induction heating coil of the group, measuring a corresponding second current peak value corresponding to the highest absolute value assumed by the AC current received by said induction heating coil during said still further half-wave of the envelope, and measuring a corresponding second electric power delivered to the load by such induction heating coil during said still further half-wave of the envelope;

setting said second global current peak value to the sum of said measured second current peak values, and setting said second global electric power value to the sum of said measured second electric powers.

Another aspect of the present invention relates to an induction heating system for heating an electrically conducting load. The induction heating system comprises an inverter circuit. The inverter circuit comprises a switching section and a resonant section. The switching section comprises switching devices adapted to generate an AC current from an AC input voltage comprising a plurality of half-waves. The resonant section comprises an induction heating coil adapted to receive the AC current for generating a corresponding time-varying magnetic field in order to generate heat in the electrically conducting load by inductive coupling. The AC current oscillates at an actuation frequency of the switching devices and has an envelope comprising a plurality of half-waves corresponding to the half-waves of the AC input voltage. The amount of heat generated in the load depends on the frequency of the AC current. The induction heating system further comprises a control unit configured to perform at least once the following sequence of phases a)-g):

a) receiving an indication about a target electric power value to be delivered to the load;

b) varying, within a same half-wave of the envelope, the actuation frequency according to a sequence of actuation frequency values, each actuation frequency value of the sequence being set for a corresponding time interval corresponding to a fraction of the duration of the half-wave of the envelope;

c) for each actuation frequency value of the sequence, calculating a corresponding current peak value based on a corresponding set of at least one absolute value peak assumed by the AC current during the corresponding time interval, so as to generate a corresponding current peak/actuation frequency relation;

d) generating an electric power/current peak relation, said electric power/current peak relation depicting how the delivered electric power varies as a function of the current peak of the AC current;

e) selecting a current peak value corresponding to the target electric power exploiting said electric power/current peak relation;

f) selecting an actuation frequency value corresponding to the selected current peak value exploiting said current peak/actuation frequency relation;

g) setting the actuation frequency based on said selected actuation frequency value.

According to an embodiment of the present invention, said inverter circuit is a selected one among a half-bridge inverter circuit, a full-bridge inverter circuit, and a quasi-resonant inverter circuit.

According to an embodiment of the present invention:

said electrically conducting load is a plate of a clothes iron and said induction heating coil is mounted on an ironing board, or said electrically conducting load is a portion of a cooking pan, and said induction heating coil is mounted in a cooking hob, or said electrically conducting load is a tank of a water heater, and said induction heating coil is mounted in a water heater.

BRIEF DESCRIPTION OF THE DRAWINGS

These, and others, features and advantages of the solution according to the present invention will be better understood by reading the following detailed description of some embodiments thereof, provided merely by way of exemplary and non-limitative examples, to be read in conjunction with the attached drawings, wherein.

DETAILED DESCRIPTION OF THE INVENTION

Figure 1A:
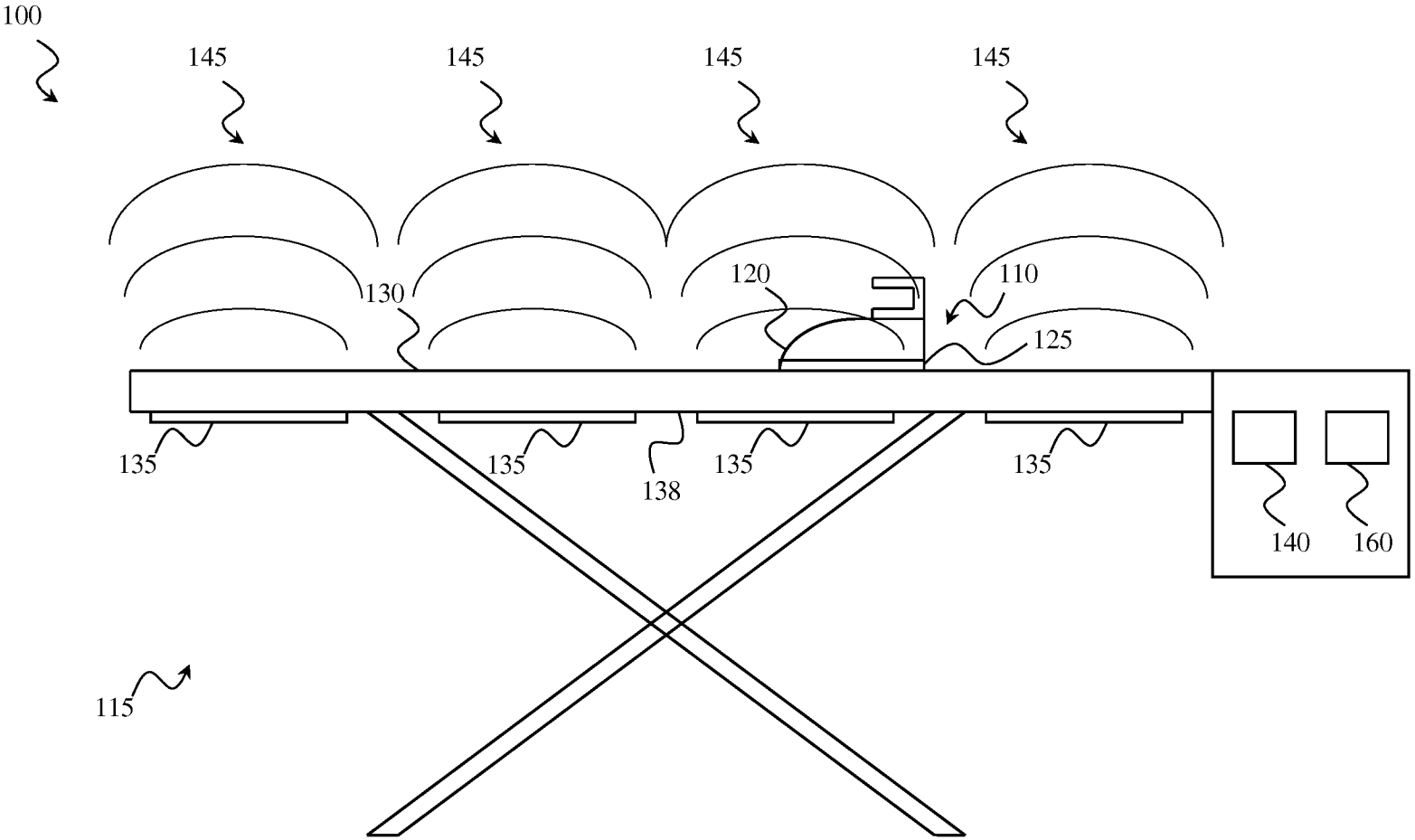
FIG. 1A illustrates an exemplary induction ironing system.

With reference to the drawings, FIG. 1A illustrates an exemplary induction ironing system 100 wherein the concepts of the solution according to embodiments of the invention can be applied.

The induction ironing system 100 comprises a clothes iron 110 and an ironing board 115.

The clothes iron 110 comprises a main body 120 made of an electrically insulating material, and a plate 125 made of an electrically conducting material, such as chrome nickel steel, for example secured to the bottom portion of the main body 120.

The clothes iron 110 is configured to travel on a main surface 130 of the ironing board 115. The main surface 130 is made of a non-conductive material. A piece of textile material to be ironed is supported on the main surface 130 in a conventional manner, not shown. Induction coils 135 are mounted, e.g., in a longitudinal, spaced arrangement, on a bottom surface 138 of the ironing board 115 opposed to the main surface 130.

In a preferred embodiment each induction coil 135 is operable to be fed with AC current provided by a respective inverter circuit 140.

When an induction coil 135 is crossed by an AC current of a suitable frequency, a time-varying magnetic field 145 is generated, which is capable of inducing eddy currents in the plate 125 of the clothes iron 110 when the latter intersects the magnetic field 145 when traveling on the main surface 130. The induced eddy currents cause the plate 125 to rapidly heat up to a desired working temperature. The thermal energy lost by contact with the (non-illustrated) textile material to be ironed is replaced continuously by the current provided by the inverter circuit 140.

The ironing board 115 is further provided with a control unit 160 configured to control the inverter circuits 140 in order to regulate the frequency of the AC current flowing in the induction coils 135 in such a way to regulate the electric power transferred from the inverter circuits 140 to the plate 125, and therefore, the temperature of the latter.

Figure 1B:
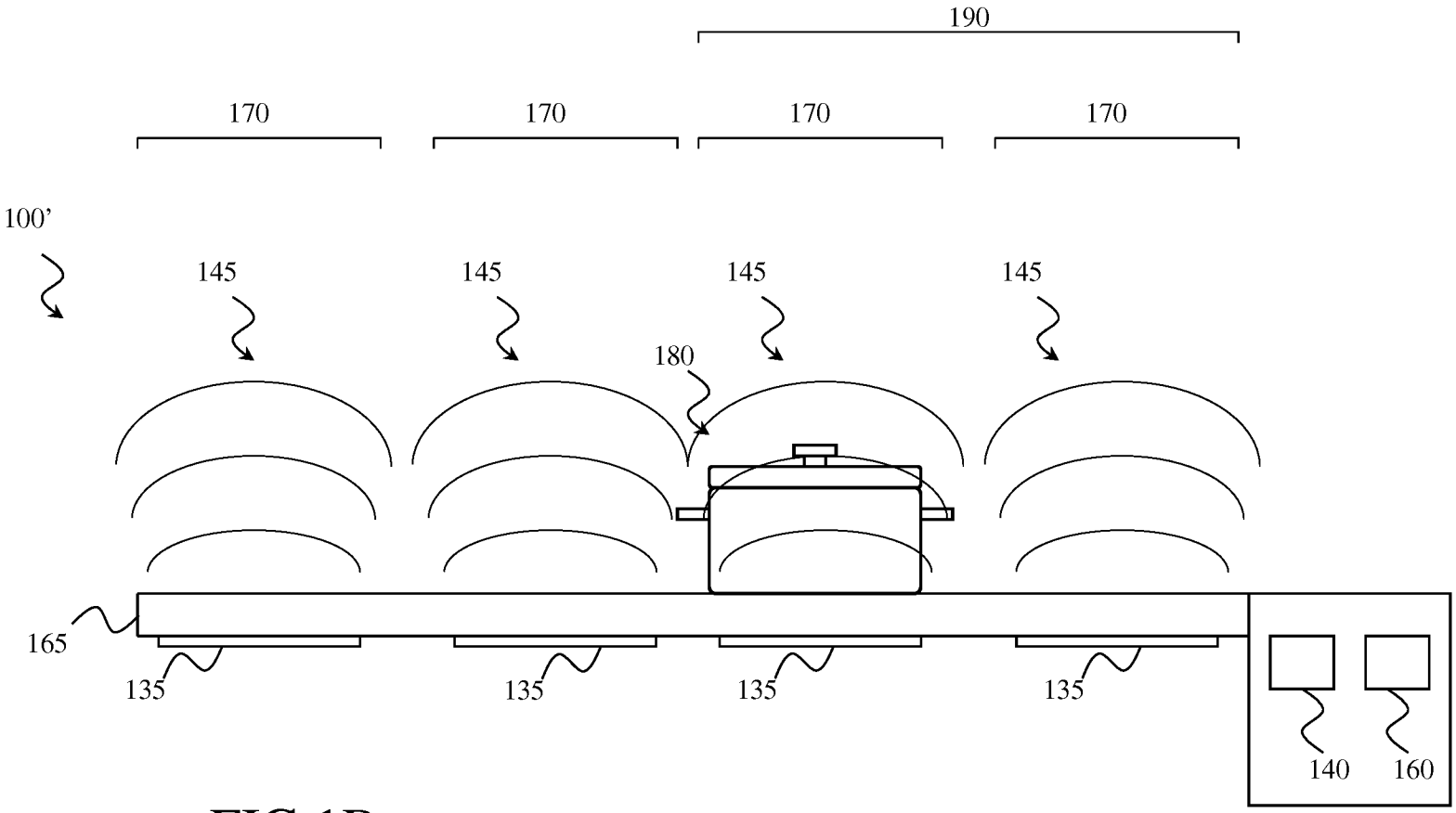
FIG. 1B illustrates an exemplary cooking hob system.

As already mentioned in the introduction of the present document, induction heating by means of induction coils may be used in other applications, such as for example in the induction cooking field. For this reason, reference is now made to FIG. 1B, which illustrates an exemplary induction cooking system 100' wherein the concepts of the solution according to embodiments of the invention can be applied.

Elements of the induction cooking system 100' which are identical or similar to corresponding elements of the induction ironing system 100 will be identified with same references.

The induction cooking system 100' comprises a (e.g., glass-ceramic) cooking surface 165. A number of induction coils 135 are placed underneath the cooking surface 165.

The induction coils 135 are selectively operable for defining one or more cooking zones 170. In a preferred embodiment each induction coil 135 is selectively operable to be fed with AC current provided by a respective inverter circuit 140.

During operation, after a cooking pan 180 made (or including portions) of ferromagnetic material (such as stainless steel or iron) and containing food to be cooked is rested on the cooking surface 165 at a cooking zone 170, the inverter circuit(s) 140 causes an AC current to flow through the (one or more) respective induction coil(s) 135. This current flow generates a time-varying magnetic field 145, which is capable of inducing eddy currents in the cooking pan 180 (or in the portions thereof made of ferromagnetic material). The induced eddy currents cause the cooking pan 180 (or the portions thereof made of ferromagnetic material) to rapidly heat up to a desired working temperature. The thermal energy lost by contact with the (non-illustrated) food contained in the cooking pan 180 is replaced continuously by the current provided by the inverter circuit 140.

As in the case of the induction ironing system 100, the induction cooking system 100' comprises a control unit 160 configured to control the inverter circuits 140 in order to regulate the frequency of the AC current flowing in the induction coils 135 in such a way to regulate the electric power transferred from the generic inverter circuit 140 to the corresponding cooking pan 180, and therefore, the temperature of the latter.

Figure 2A:
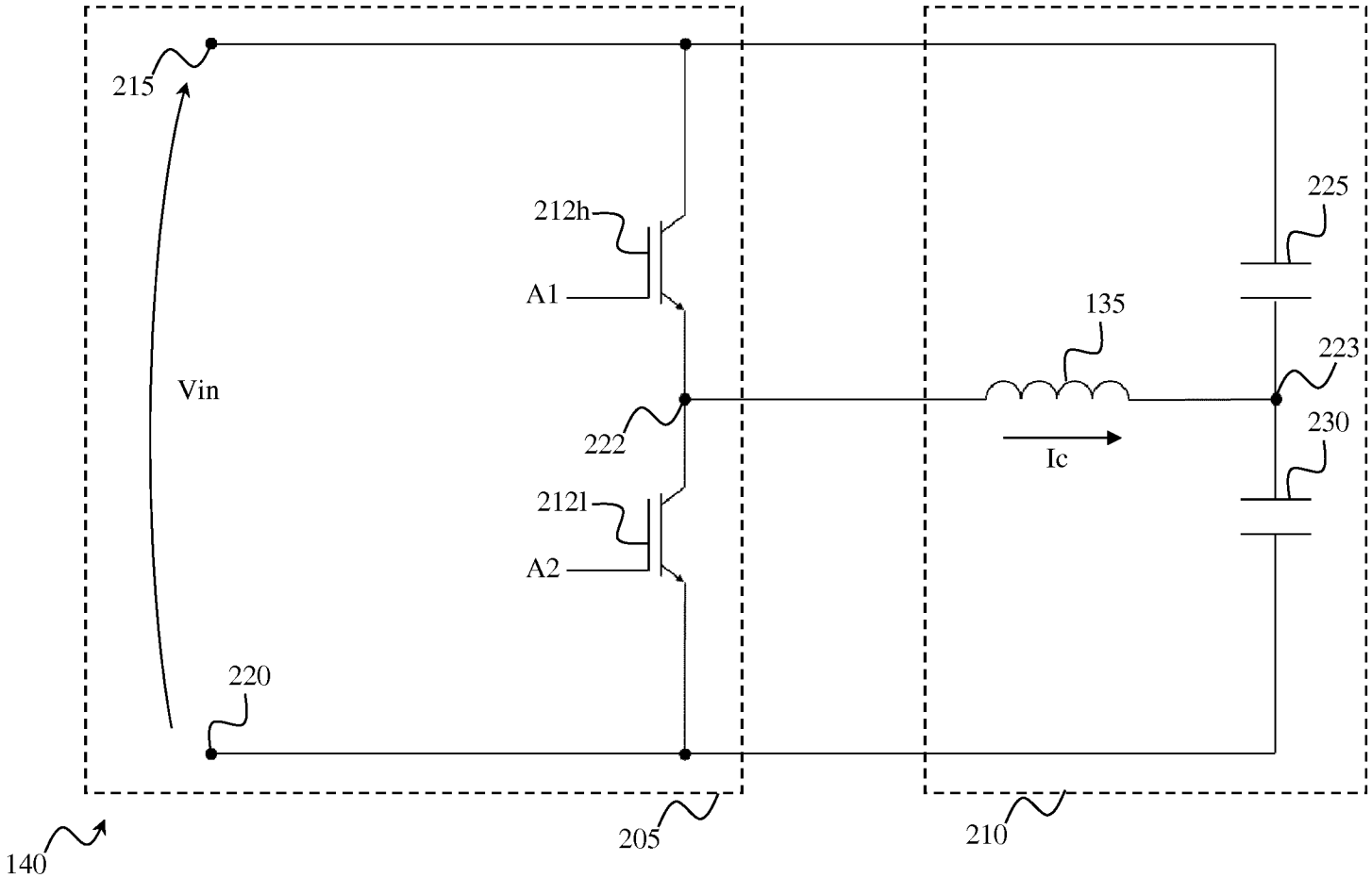
FIG. 2A is an exemplary circuit diagram of an inverter circuit for feeding AC current to an induction coil of the ironing system of FIG. 1A or of the cooking hob system of FIG. 1B.

FIG. 2A is an exemplary circuit diagram of an inverter circuit 140 for feeding AC current to an induction coil 135 of the ironing system 100 or of the induction cooking system 100' wherein the concepts of the solution according to embodiments of the invention can be applied. In the example at issue, the inverter circuit 140 is a half-bridge inverter circuit, however similar considerations apply in case different types of inverter circuits arrangements are used, such as a full-bridge inverter circuit or a quasi-resonant inverter circuit.

The inverter circuit 140 comprises two main sections: a switching section 205 and a resonant section 210.

The switching section 205 comprises two insulated-gate bipolar transistors (IGBT) 212*h*, 2121 connected in series between the line terminal 215 and the neutral terminal 220 of the power grid. An input AC voltage Vin (the mains voltage) develops between the line terminal 215 and the neutral terminal 220, oscillating at a mains frequency Fm, such as 50 Hz. The IGBT 212*h* has a collector terminal connected to the line terminal 215, a gate terminal for receiving a control signal A1, and an emitter terminal connected to the collector terminal of the IGBT 2121, defining a circuit node 222 therewith. The IGBT 2121 has an emitter terminal connected to neutral terminal 220 and a gate terminal for receiving a control signal A2. The control signals A1 and A2 are digital periodic signals oscillating at a same frequency, hereinafter referred to as actuation frequency Fa, between a high value and a low value, with a mutual phase difference of 180°, so that when the IGBT 212*h* is turned on, the IGBT 2121 is turned off, and viceversa. Similar considerations apply if different types of electronic switching devices are employed in place of IGBTs.

The resonant section 210 comprises the induction coil 135 and two resonance capacitors 225, 230. The resonance capacitor 225 has a first terminal connected to the collector terminal of the IGBT 212*h* and a second terminal connected to a first terminal of the resonance capacitor 230, defining a circuit node 223 therewith. The resonance capacitor 230 has a second terminal connected to the emitter terminal of the IGBT 2121.

The induction heating coil 135 is connected between circuit nodes 222 and 223.

Figure 3:
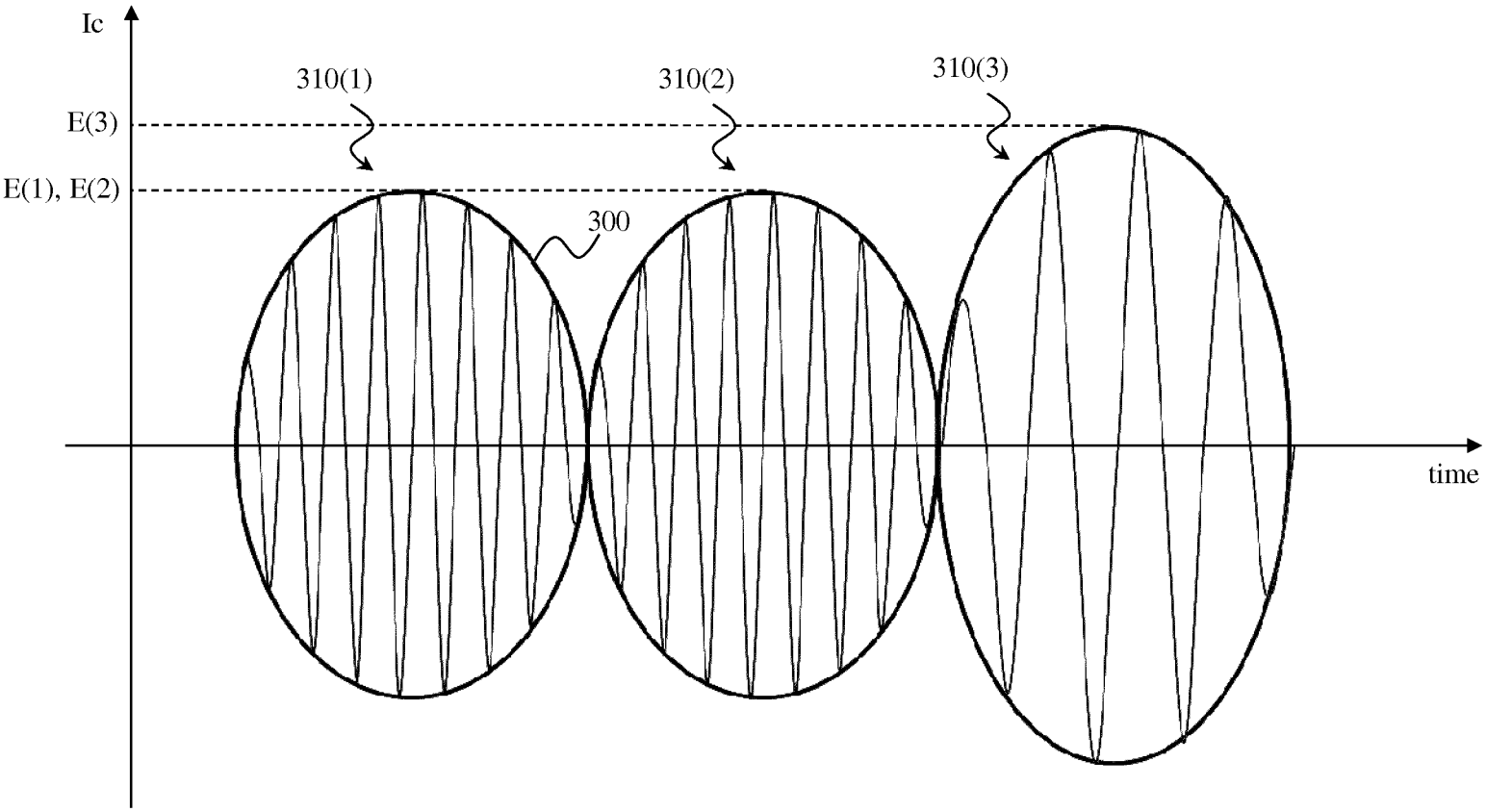
FIG. 3 illustrates a time trend of the induction heating coil current of the inverter circuit of FIG. 2A, as well as the envelope of such current.

During operation, the current Ic flowing through the induction heating coil 135 is alternatively sourced by the IGBT 212*h* (when the IGBT 212*h* is on and the IGBT 2121 is off) and drained by the IGBT 2121 (when the IGBT 212*h* is off and the IGBT 2121 is on). As illustrated in FIG. 3, the induction heating coil current Ic oscillates at the actuation frequency Fa, and has an envelope 300 that follows the input AC voltage Vin, i.e., it comprises a plurality of half waves 310(*i*), each one corresponding to a respective half wave of the input AC voltage Vin and therefore having a duration equal to the semiperiod of the input AC voltage Vin (i.e., 1/(2*FM). At the end of each half wave of the envelope 300, the induction heating coil current Ic returns to zero (if an actuation with a suitable load is performed). The envelope 300 has an amplitude that depends on the actuation frequency Fa: the lower the actuation frequency Fa, the higher the amplitude. The portion of the envelope 300 of the induction heating coil current Ic illustrated in FIG. 3 has three half waves 310(1), 310(2), 310(3), each one having a corresponding amplitude E(1), E(2), E(3). The first two half waves 310(1), 310(2) of the envelope 300 correspond to an actuation frequency Fa higher than the one corresponding to the third half wave 310(3). Therefore, the amplitude E(3) of the third half wave 310(3) is higher than the one of the first two half waves 310(1), 310(2).

Figure 2B:
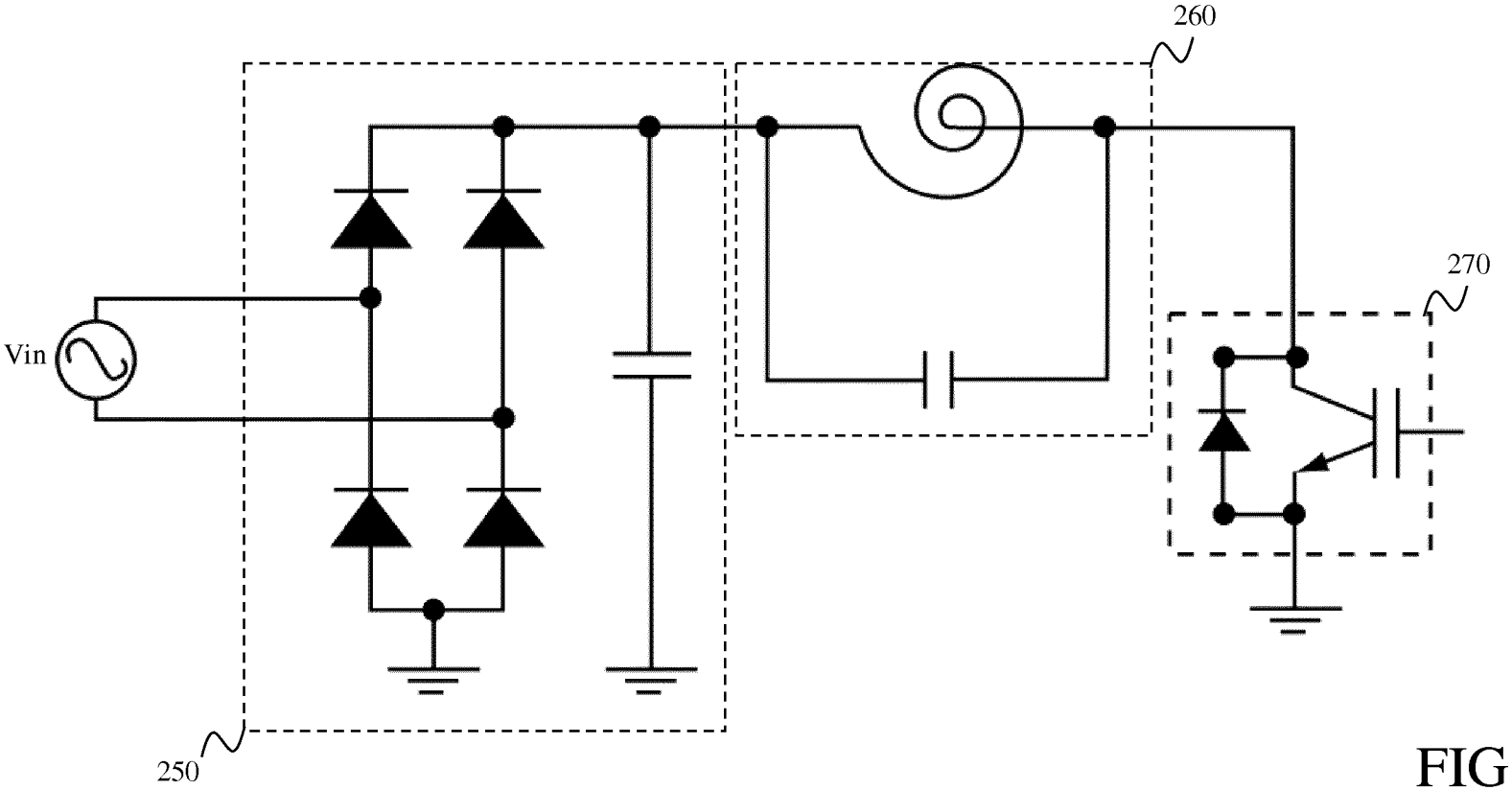
FIG. 2B is an exemplary circuit of another inverter circuit for feeding AC current to an induction coil of the ironing system of FIG. 1A or of the cooking hob system of FIG. 1B.

As mentioned above, the concepts of the present invention can be applied as well to an inverter circuit 140 of the quasi-resonant type, such as the one illustrated in FIG. 2B, comprising a rectifier 250 (for example, a bridge rectifier) adapted to rectify the input AC voltage Vin, a quasi-resonant circuit 260 (for example comprising an inductor in parallel to a capacitor) corresponding to the resonant section 210 of the half-bridge inverter circuit 140 of FIG. 2A, and a switching circuit 270 (for example comprising a single transistor) corresponding to the switching section 205 of the half-bridge inverter circuit 140 of FIG. 2A.

A possible method for managing induction heating systems provide for carrying out a preliminary inspection phase (i.e., carried out before the actual power delivery phase) in which the actuation frequency Fa is varied step by step according to a sequence of predetermined actuation frequency values, with each actuation frequency value of the sequence that is maintained for a respective half wave (or also more than one consecutive half waves) of the envelope of the AC voltage Vin. For each actuation frequency value, a corresponding power measurement is carried out. A power characteristic curve is then construed from such measurements, expressing how the power deliverable to the load varies in function of the actuation frequency Fa.

According to another possible method, instead of carrying out a dedicated preliminary inspection phase, the power delivery phase is immediately initiated by setting the actuation frequency Fa step by step, with each actuation frequency value of the sequence that is maintained for a respective half wave of the envelope of the AC voltage Vin, starting from a safe (e.g., high) actuation frequency value, and continuing until the desired power value is reached or until a frequency close to the resonance frequency Fr is reached (if the latter actuation frequency occurs prior the one corresponding to desired power value).

Applicant has observed that such methods described above are time consuming and require to perform operations every half wave of the envelope of the AC voltage Vin. Thus, they are capable of obtaining results only after relatively long time periods, such as for example from 0.1 sec up to 2 sec (with an input AC voltage Vin oscillating at 50 Hz, it means 10 to 200 halfwaves).

Applicant has observed that in several applications, such as in induction ironing, the coupling between the load (i.e., the plate 125) and the induction heating coil 135 may change in a very fast way (e.g., every 0.1-0.5 sec), which is not compatible with the time required by the inspection methods mentioned above. Indeed, since ironing process is a process which is essentially dynamic and user dependent, the load-coil coupling may change every time the position of the clothes iron 110 changes with respect to the position of the induction heating coil 135. Therefore, the inspection methods mentioned above are not efficient from the power delivery point of view.

According to an embodiment of the present invention, when the temperature setting provided by the user of the ironing system 100 involves the request of a specific amount of electric power Pt to be delivered, the control unit 160 is configured to dynamically carry out an actuation frequency selection procedure adapted to asses a value Fa* of the actuation frequency Fa that corresponds to the requested electric power Pt.

Then, the control unit 160 is configured to actually set the frequency of the AC current flowing in the induction coils 135 (i.e., the actuation frequency Fa) taking into consideration the assessed value Fa*, in such a way to regulate the delivered electric power according to the request of the user.

The actuation frequency selection procedure according to an embodiment of the present invention will be now described in detail.

According to an embodiment of the present invention, the actuation frequency selection procedure comprises a first phase in which the control unit 160 varies step by step the actuation frequency Fa of the control signals A1, A2 according to a sequence of actuation frequency values TFa(j) within a same half wave 310(*i*) of the envelope 300 of the current Ic, for measuring corresponding peak values of the induction heating coil current Ic to generate a corresponding actuation frequency/current peak relation.

The first phase according to an embodiment of the present invention is initiated by the control unit 160 by setting the actuation frequency Fa to the first actuation frequency value TFa(1) of the sequence as soon as a halfwave 310(*i*) of the envelope 300 of the induction heating coil current Ic is initiated. This can be detected by assessing the zero crossing time of the input AC voltage Vin (which identifies the beginning of a halfwave 310(*i*) of the envelope 300) through a proper zero voltage crossing circuit (not illustrated). The following actuation frequency values TFa(j) of the sequence are then set step by step by the control unit 160 within the same halfwave 310(*i*) of the envelope 300. Therefore, for an input AC voltage Vin oscillating at a mains frequency Fm of 50 Hz, the first phase lasts at most 10 ms. As will be described in detail in the following of the description, as soon as the actuation frequency Fa is set to a new actuation frequency value TFa(j), the control unit 160 measures corresponding peak values of the induction heating coil current Ic.

According to an embodiment of the present invention, the sequence of actuation frequency values TFa(j) is a predefined sequence, for example stored in the control unit itself 160 in form of tables or defined by means of a mathematic relationship.

Figure 4A:
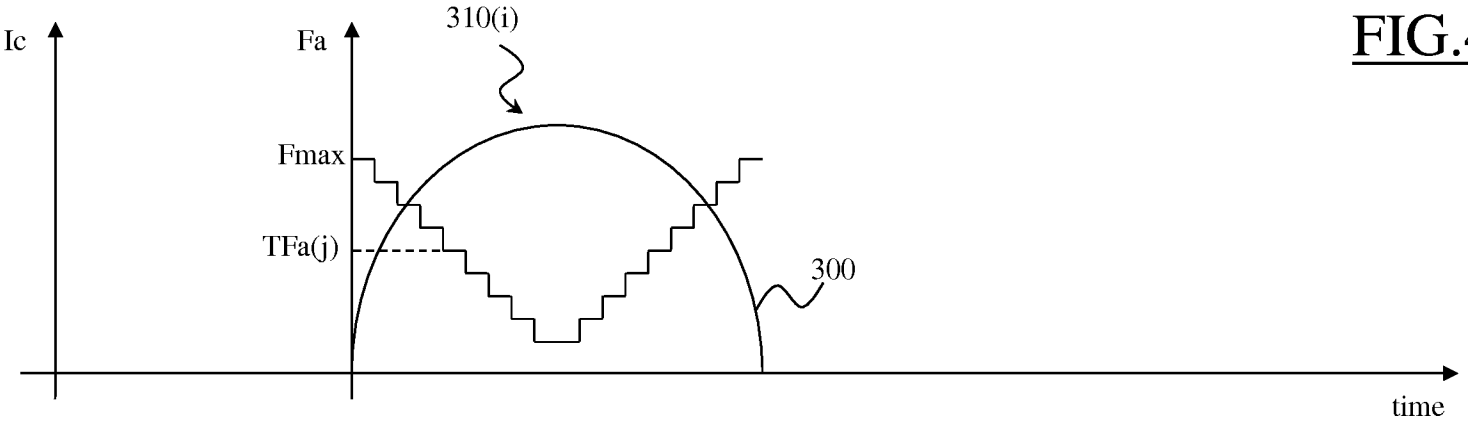
FIGS. 4A and 4B illustrate the evolution in time of the actuation frequency of control signals of the inverter circuit of FIG. 2A during an actuation frequency selection procedure according to embodiments of the invention following two exemplary different predefined sequences of actuation frequency values.
Figure 4B:
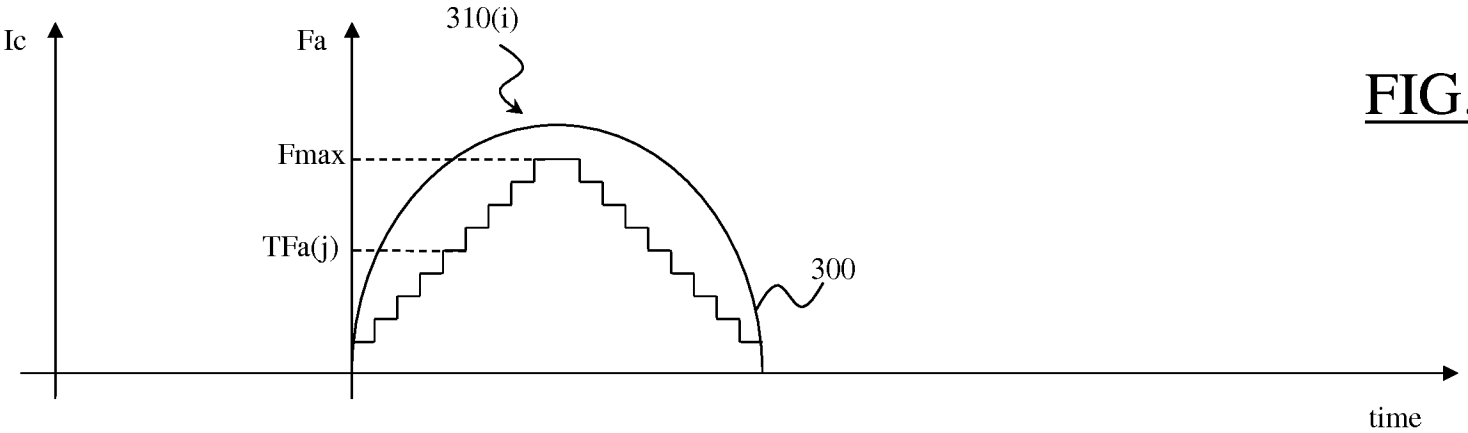

FIGS. 4A and 4B illustrate the evolution in time of the actuation frequency Fa of the control signals A1, A2 set by the control unit 160 during the procedure according to embodiments of the invention following two exemplary different predefined sequences of actuation frequency values TFa(j).

In the example illustrated in FIG. 4A, the predefined sequence of actuation frequency values TFa(j) provides for starting from a first actuation frequency value TFa(1), then proceeding with lower and lower actuation frequency values TFa(j) every time interval tj equal to a fraction of the semiperiod of the input AC voltage Vin (and therefore equal to a fraction of the duration of the half wave 310(*i*) of the envelope 300), until substantially reaching the centre of the half wave 310(*i*); then, the predefined sequence of actuation frequency values TFa(j) provides for proceeding with higher and higher actuation frequency values TFa(j) every time interval tj until reaching the end of the half wave 310(*i*). For example, tj may be equal to 0.3 msec. In this way, as visible in FIG. 4A, the evolution in time of the actuation frequency Fa comprises a decreasing ramp followed by an increasing ramp. According to an embodiment of the present invention, the first actuation frequency value TFa(1) of the sequence is advantageously set to the maximum switching frequency Fmax of the IGBTs.

In the example illustrated in FIG. 4B, the predefined sequence of actuation frequency values TFa(j) provides for starting from a first actuation frequency value TFa(1), then proceeding with higher and higher actuation frequency values TFa(j) every time interval tj equal to a fraction of the semiperiod of the input AC voltage Vin (and therefore equal to a fraction of the duration of the half wave 310(*i*) of the envelope 300), until substantially reaching the centre of the half wave 310(*i*); then, the predefined sequence of actuation frequency values TFa(j) provides for proceeding with lower and lower actuation frequency values TFa(j) every time interval tj until reaching the end of the half wave 310(*i*). In this way, as visible in FIG. 4B, the evolution in time of the actuation frequency Fa comprises an increasing ramp followed by a decreasing ramp. According to an embodiment of the present invention, the higher actuation frequency value TFa(j) of the sequence (i.e., the one corresponding to substantially the centre of the half wave 310(*i*)) is advantageously set to the maximum switching frequency Fmax of the IGBTs.

The symmetry of the predefined sequence of actuation frequency values TFa(j) illustrated in FIG. 4A (i.e., with a decreasing ramp followed by an increasing ramp) and in FIG. 4B (i.e., with an increasing ramp followed by a decreasing ramp) allows to advantageously carry out a double measurement, improving the reliability of the result. However similar considerations apply in case such symmetry is not present, such as for example with a single decreasing ramp or a single increasing ramp. Moreover, the concepts of the present invention can be applied as well to different types of predefined sequences of actuation frequency values TFa(j), having any profile, provided that the actuation frequency Fa is varied within the half wave 310(*i*) of the envelope 300.

According to an embodiment of the present invention, the control unit 160 measures at each j-th step of the sequence:

a corresponding positive peak Ipp(j) of the induction heating coil current Ic, i.e., the highest positive value assumed by the induction heating coil current Ic oscillating at the frequency Fa=TFa(j) during the time interval tj, and a corresponding negative peak Inp(j) of the induction heating coil current Ic, i.e., the lowest negative value assumed by the induction heating coil current Ic oscillating at the frequency Fa=TFa(j) during the time interval tj.

Figure 5:
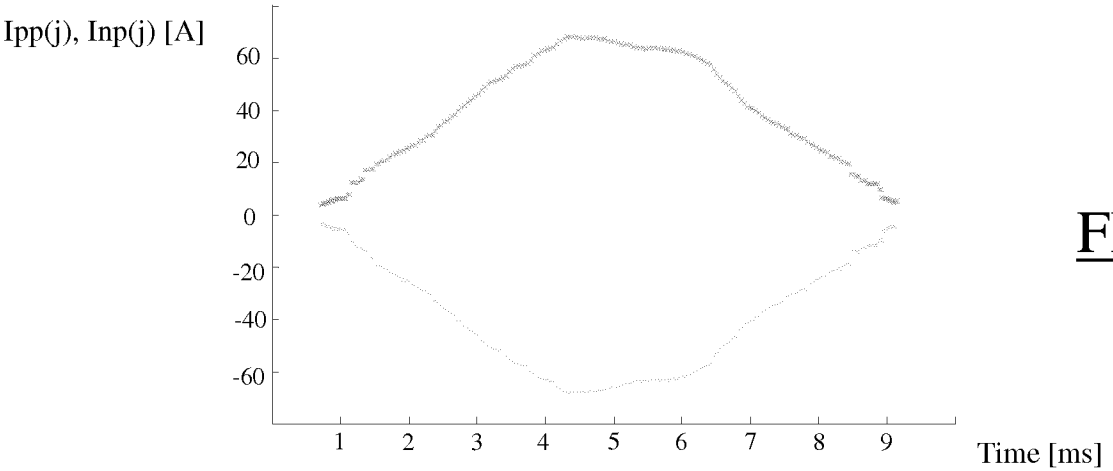
FIG. 5 illustrates measured positive peaks and negative peaks of the induction heating coil current versus time during an actuation frequency step by step variation according to an embodiment of the present invention.
Figure 6:
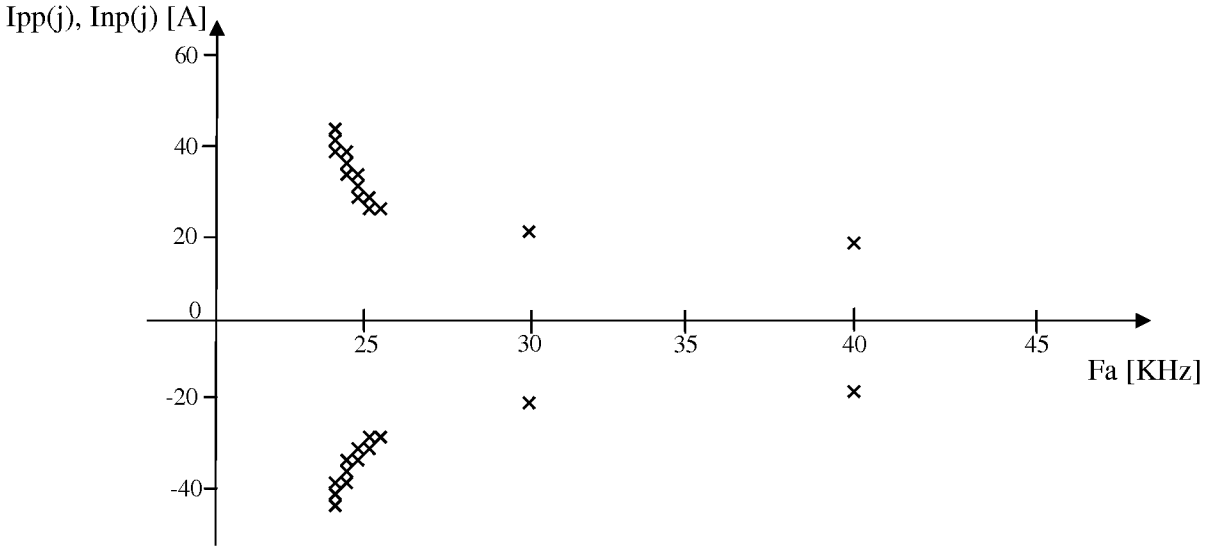
FIG. 6 illustrates the same positive and negative peaks of FIG. 5 versus the actuation frequency.

FIG. 5 illustrates, as a result of a test performed by the Applicant, a current peak/time relation CTR of the positive peaks Ipp(j) and the negative peaks Inp(j) measured by the control unit 160 with respect to time during an actuation frequency Fa step by step variation within an half wave 310(*i*) of the envelope 300, while FIG. 6 illustrates a current peak/actuation frequency relation CFR of the same positive and negative peaks Ipp(j), Inp(j) with respect to the actuation frequency Fa.

It has to be appreciated that the measures are carried out by varying the actuation frequency Fa within a same half wave 310(*i*) of the envelope 300, and the values of the positive and negative peaks Ipp(j), Inp(j) also depend on the position of the respective time interval tj with respect to the half wave 310(*i*) (the more the time interval tj is close to the centre of the half wave 310(*i*), the higher the positive and negative peaks Ipp(j), Inp(j) (in absolute value)). Therefore, said measured values of the positive and negative peaks Ipp(j), Inp(j) are not indicative of the actual current peaks that could be measured using the actuation frequency value Fa=TFa(j) for the whole duration of the half wave 310(*i*). Indeed, a current peak Ipp(j) corresponding to an actuation frequency Fa=TFa(j) measured at the begin or at the end of the half wave 310(*i*) will be lower than a current peak Ipp(j) corresponding to the same actuation frequency value but measured at the middle of the half wave 310(*i*).

For this purpose, according to an embodiment of the present invention the control unit 160 is further configured to process (e.g., normalize) said measures so as to obtain corresponding compensated (e.g., normalised) positive and negative peaks NIpp(j), NInp(j) expressing an estimate of how such positive and negative peaks Ipp(j), Inp(j) would be if the measure was carried out during a time interval tj corresponding to the whole duration of the half wave 310(*i*) and therefore with a corresponding actuation frequency value Fa=TFa(j) set for the whole duration of the half wave 310(*i*).

According to an embodiment of the present invention, the normalised positive and negative peaks NIpp(j), NInp(j) are obtained by modifying each corresponding positive and negative peak Ipp(j), Inp(j) according to the position of the time interval tj of the measure with respect to the half wave 310(*i*). For example, according to an embodiment of the present invention, the normalised positive and negative peaks NIpp(j), NInp(j) are obtained by modifying each corresponding positive and negative peak Ipp(j), Inp(j) through (e.g., by multiplying them by) an expansion coefficient ec(j) whose value depends on the position of the time interval tj of the measure with respect to the half wave 310(*i*). For example, according to an embodiment of the present invention, the more the time interval tj is far from the centre of the half wave 310(*i*), the higher the expansion coefficient ec(j). According to an embodiment of the present invention, the position of the time interval tj with respect to the half wave 310(*i*) is determined by measuring the value of the input AC voltage Vin during the time interval tj.

Figure 7:
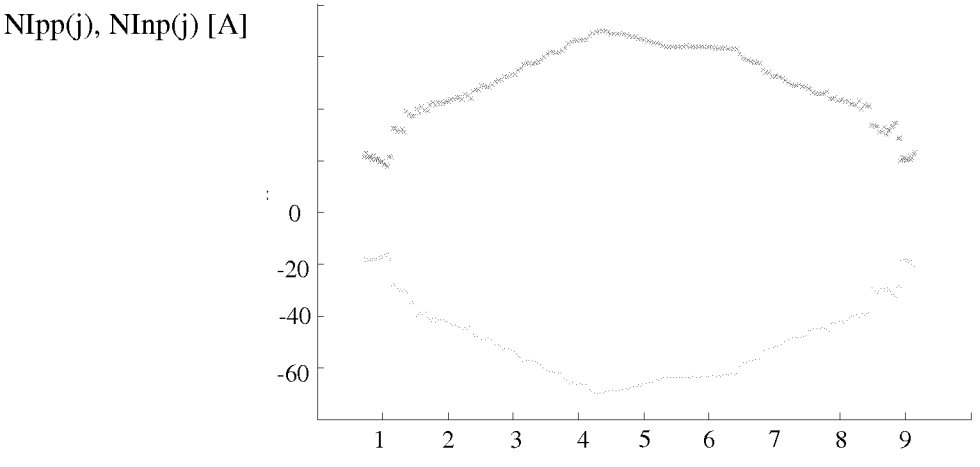
FIG. 7 illustrates normalised positive peaks and normalised negative peaks versus time obtained from the measured positive peaks and the negative peaks of FIG. 5.
Figure 8:
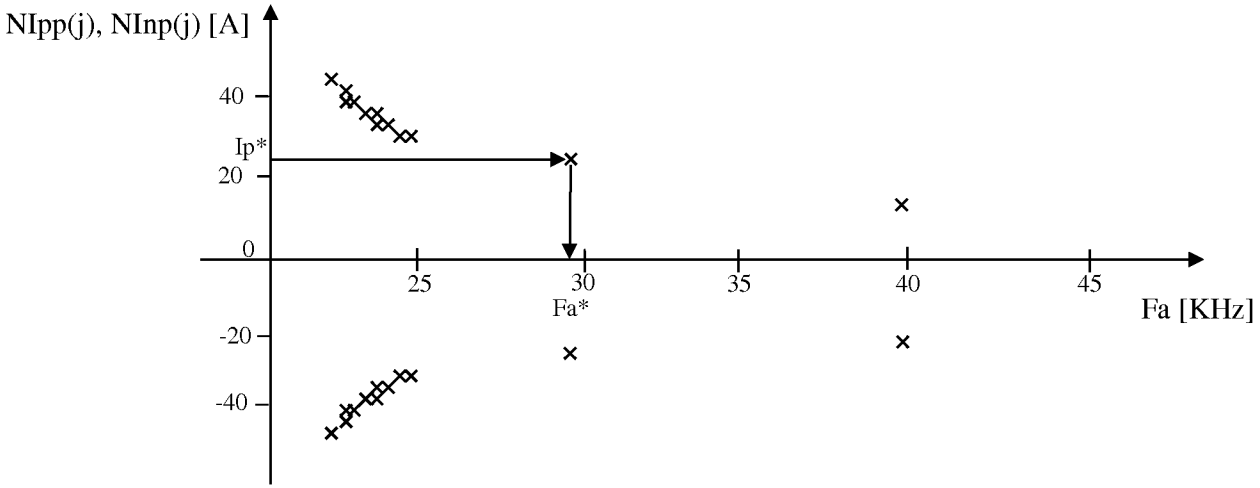
FIG. 8 illustrates the same normalised positive and negative peaks of FIG. 7 versus the actuation frequency.

FIG. 7 illustrates a normalised current peak/time relation NCTR of the normalised positive peaks NIpp(j) and the normalised negative peaks NInp(j) with respect to time obtained from the measured positive peaks Ipp(j) and the negative peaks Inp(j) of the current peak/time relation CTR of FIG. 5. FIG. 8 illustrates a normalised current peak/actuation frequency relation NCFR of the same normalised positive and negative peaks NIpp(j), NInp(j) with respect to the actuation frequency Fa which depicts how the current peak varies as a function of the actuation frequency Fa (and vice versa).

According to an embodiment of the present invention, the normalised positive and negative peaks NIpp(j), NInp(j) versus the actuation frequency values TFa(j) of the normalised current peak/actuation frequency relation NCFR are collected and stored, for example in a memory unit (not shown in the figures) by the control unit 160, for example in form of a data table DT.

The next phases of the actuation frequency selection procedure according to an embodiment of the present invention provides for the generation of an electric power/current peak relation PCR depicting how the delivered electric power varies as a function of the current peak of the AC current flowing in the induction coils 135.

According to an embodiment of the present invention, the electric power/current peak relation PCR is generated taking into account only the normalised positive peaks Nipp(j).

According to another embodiment of the present invention, the electric power/current peak relation PCR is generated taking into account only the normalised negative peaks Ninp(j).

According to a still further embodiment of the present invention, the electric power/current peak relation PCR is generated taking into account the average value of the absolute value of the normalised positive and negative peaks NIpp(j), NInp(j).

As will be described in detail in the following of the present description, by exploiting said electric power/current peak relation PCR together with said normalised current peak/actuation frequency relation NCFR, the control unit 160 is capable of assessing the value Fa* of the actuation frequency Fa that corresponds to a requested electric power Pt.

According to an embodiment of the present invention, instead of generating the electric power/current peak relation PCR by performing a high number of electric power measurements for a corresponding number of different current peaks (which is very time consuming), only a reduced set of measurements is actually carried out (for example, two), and the electric power/current peak relation PCR is generated by interpolating said reduced set of measurements with a mathematical function.

For this purpose, the second phase of the actuation frequency selection procedure according to an embodiment of the present invention provides for setting the actuation frequency Fa of the control signals A1, A2 to a first actuation frequency value Tfa' for the entire duration of a subsequent half wave 310(*i*) of the envelope 300, and to measure the amount of delivered electric power P' corresponding to said first actuation frequency value Tfa', for example, by directly measuring the peak current Ip' and voltage V' during said half wave 310(*i*) of the envelope 300. For an input AC voltage Vin oscillating at a mains frequency Fm of 50 Hz, the second phase lasts at most 10 ms.

According to an embodiment of the invention, the first actuation frequency value Tfa' may be advantageously selected from one of the actuation frequency values TFa(j) used in the first phase of the procedure directed to the generation of the normalised current peak/actuation frequency relation NCFR.

According to an embodiment of the invention, the first actuation frequency value Tfa' may be advantageously equal to or higher than a resonance frequency Fr of the resonant section 210 of the inverter circuit 140.

The third phase of the the actuation frequency selection procedure according to an embodiment of the present invention provides for setting the actuation frequency Fa of the control signals A1, A2 to a second actuation frequency value Tfa" for the entire duration of a further subsequent half wave 310(*i*) of the envelope 300, and to measure the amount of delivered electric power P" corresponding to said second actuation frequency value Tfa", for example, by directly measuring the peak current Ip" and voltage V" during said half wave 310(*i*) of the envelope 300. For an input AC voltage Vin oscillating at a mains frequency Fm of 50 Hz, the third phase lasts at most 10 ms.

According to an embodiment of the invention, the second actuation frequency value Tfa" may be advantageously selected from one of the actuation frequency values TFa(j) used in the first phase of the procedure directed to the generation of the normalised current peak/actuation frequency relation NCFR.

According to an embodiment of the invention, the second actuation frequency value Tfa" may be advantageously equal to or lower than the highest actuation frequency value the IGBT 212*h* and the IGBT 2121 are able to sustain.

According to an embodiment of the present invention, the two measured pairs (Ip', P'), (Ip", P") are exploited by the control unit 160 to generate the electric power/current peak PCR relation depicting how the delivered electric power varies as a function of the current peak of the AC current flowing in the induction coils 135.

For this purpose, according to an embodiment of the present invention, a mathematical function expressing a relation between electric power values and current peak values (and vice versa) is selected, with the two measured pairs (Ip', P'), (Ip", P") that satisfies said mathematical function.

According to an embodiment of the present invention, unlike the normalised current peak/actuation frequency relation NCFR, which may be stored by the control unit 160 by directly memorizing in a memory unit a data table DT providing normalised positive and negative peak values NIpp(j), NInp(j) versus actuation frequency values TFa(j), the electric power/current peak relation PCR may be advantageously stored by the control unit 160 by memorizing, for example in the same or another memory unit, the mathematical formula MF of the selected mathematical function.

Figure 9A:
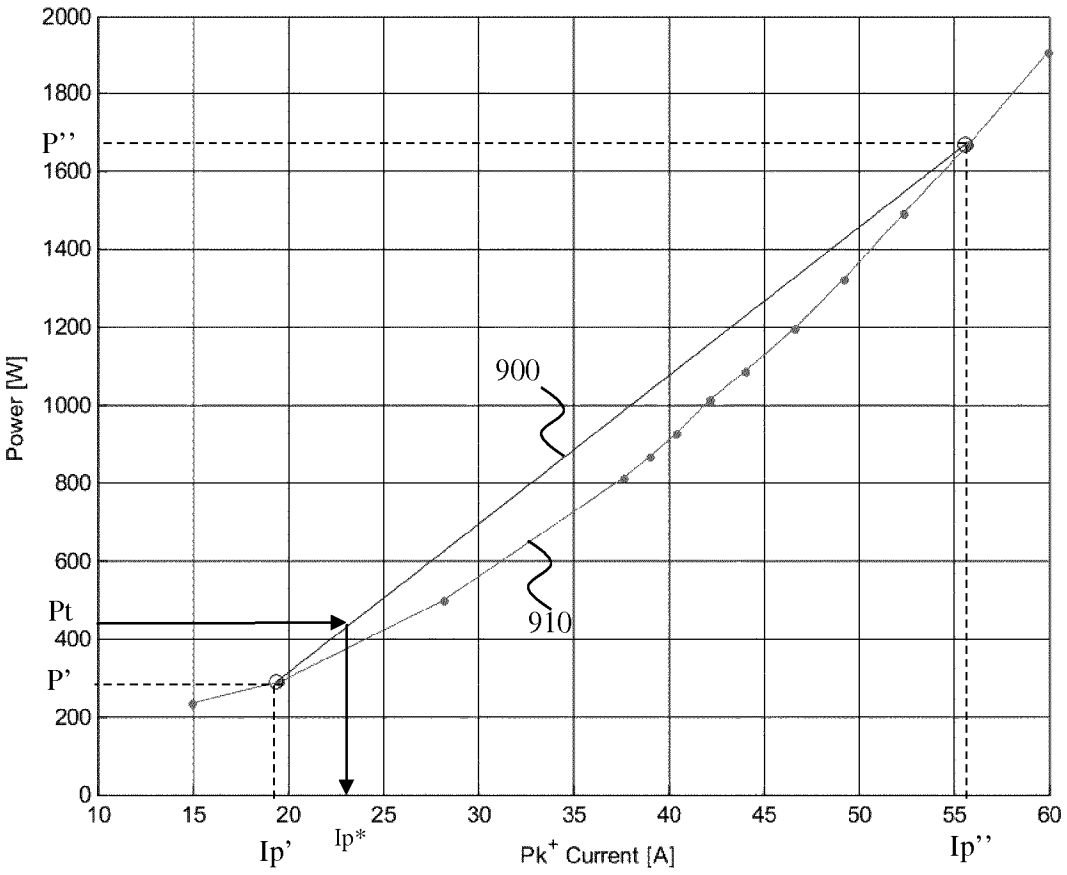
FIG. 9A is a diagram illustrating an electric power/current peak relation according to an embodiment of the present invention.
Figure 9B:
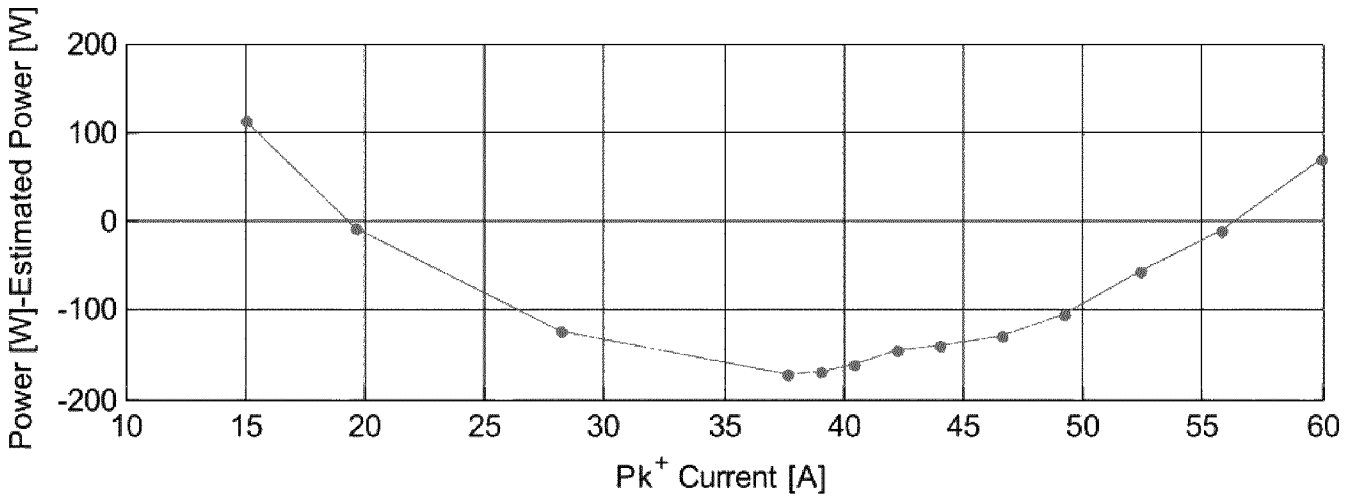
FIG. 9B is a diagram illustrating the expected error resulting from using the electric power/current peak relation of FIG. 9A.

According to an exemplary embodiment of the invention illustrated in FIG. 9A, said mathematical function is a linear function 900 (a line) in the electric power/current peak plane, passing through the two points (Ip', P'), (Ip", P"). FIG. 9A also discloses an electric power/current peak curve 910 obtained by interpolating a higher number of points obtained by directly measuring the delivered electric power for a higher number of peak current values (and thus by employing a higher amount of time). As can be seen in the diagram illustrated in FIG. 9B, the expected error resulting from exploiting the linear function 900 instead of the curve 910 is higher for the peak current values (and for the electric power values) which are far from the two measured points (Ip', P'), (Ip", P").

It has to be appreciated that in order to obtain the electric power/current peak relation PCR and the normalised current peak/actuation frequency relation NCFR according to the embodiment of the invention herein considered, only the time corresponding to three half-waves 310(*i*) of the envelope 300 is required: a first half-wave 310(*i*) for the generation of the normalised current peak/actuation frequency relation NCFR, and a second and a third half-waves 310(*i*) for the generation of the electric power/current peak relation PCR (with the second half-wave 310(*i*) directed to the identification of the pair of values (Ip', P') and the third half-wave 310(*i*) directed to the identification of the pair of values (Ip", P")). For an input AC voltage Vin oscillating at a mains frequency Fm of 50 Hz, the required amount of time lasts at most 30 ms.

Once the control unit 160 has generated both the electric power/current peak relation PCR and the normalised current peak/actuation frequency relation NCFR, the control unit 160 is configured to assess the value Fa* of the actuation frequency Fa to be set for delivering an amount of electric power corresponding to the electric power Pt requested by the user in the following way.

By exploiting the electric power/current peak relation PCR, the control unit 160 is configured to identify the current peak value Ip* corresponding to the electric power Pt requested by the user. For this purpose, the control unit 160 is configured to apply the value of the requested electric power Pt to the mathematical function stored in the control unit 160, so as to calculate a corresponding current peak value Ip* (see arrows depicted in FIG. 9A).

Once the current peak value Ip* has been identified, the control unit 160 is configured to exploit the normalised current peak/actuation frequency relation NCFR to identify a value Fa* of the actuation frequency Fa corresponding to such calculated current peak value Ip* corresponding to the requested electric power Pt. For this purpose, the control unit 160 is configured to search in the data table DT to select the normalised positive and/or negative peak value NIpp(j), NInp(j) (or the average value of the absolute value of NIpp(j), NInp(j)) which is closest (in absolute value) to the calculated current peak value Ip*, and then to identify the value Fa* by extracting from the data table DT the actuation frequency value TFa(j) corresponding to the selected normalised positive or negative peak value NIpp(j), NInp(j) (see arrows depicted in FIG. 8).

According to another embodiment of the present invention, in order to obtain more precise results, the value Fa* of the actuation frequency Fa corresponding to such calculated current peak value Ip* may be identified by exploiting an interpolation of the data stored in the data table DT. For this purposes, the normalised current peak/actuation frequency relation NCFR may be interpolated by linearly interpolating said relation at each pair of adjacent normalised positive and/or negative peak values NIpp(j), NInp(j) stored in the data table DT.

At this point, the control unit 160 is configured to actually set the frequency of the AC current flowing in the induction coils 135 (i.e., the actuation frequency Fa) to the assessed value Fa*, in such a way to regulate the delivered electric power according to the request of the user.

Thanks to the proposed procedure, it is possible to set the actuation frequency Fa corresponding to a requested electric power in a very short time (for an input AC voltage Vin oscillating at a mains frequency Fm of 50 Hz, the procedure lasts about 30 ms), which is fully compatible with the fast changes of the coupling between the load and the induction heating coil typical of induction ironing. Therefore, compared with the known procedures, the proposed procedure is more efficient from the time execution speed and the power delivery points of view.

The previously described procedure may be repeated several times (either consecutively or not) to improve the reliability of the result, in such a way to track the fast changes of the coupling between the load and the induction heating coil.

The concepts of the present invention may be applied by considering a number of current peak/electric power measured pairs different from two (i.e., by directly measuring the electric power at a different number of actuation frequency values TFa(j)), and/or by considering mathematical functions different from a linear function.

Figure 10A:
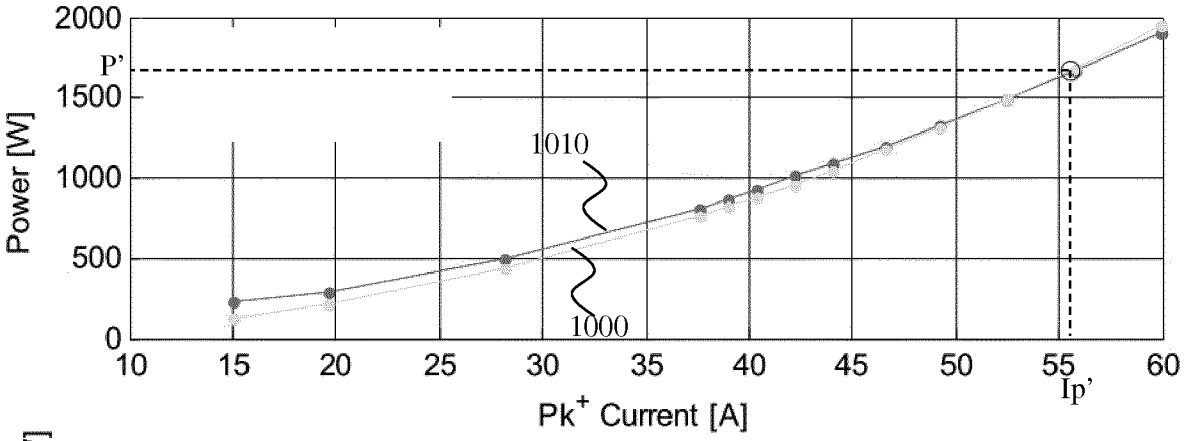
FIG. 10A is a diagram illustrating an electric power/current peak relation according to another embodiment of the present invention.
Figure 10B:
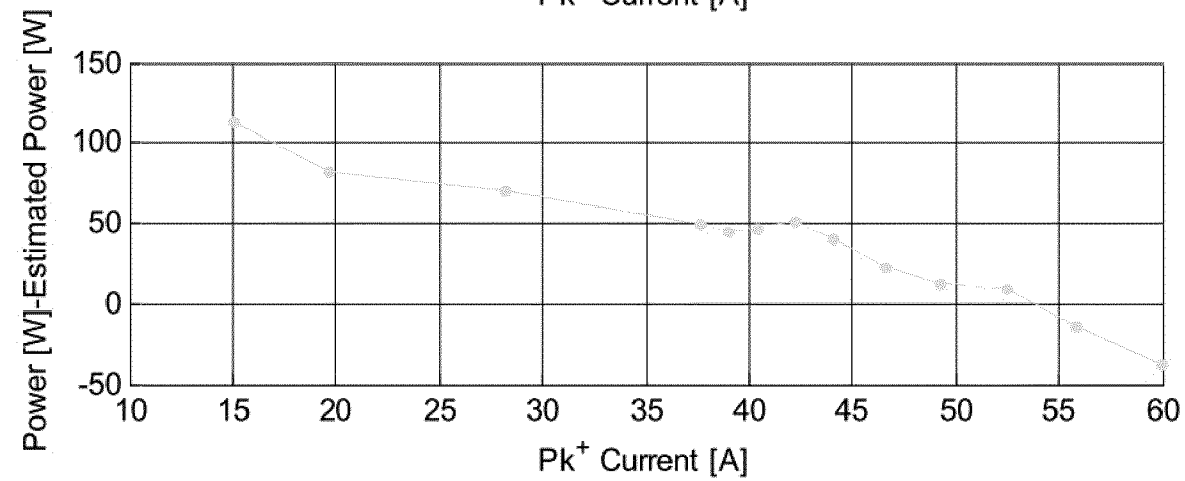
FIG. 10B is a diagram illustrating the expected error resulting from using the electric power/current peak relation of FIG. 10A.

For example, according to an embodiment of the present invention illustrated in FIG. 10A, the mathematical function is a quadratic function 1000 (for example a parable) in the electric power/current peak plane, passing through a single point (Ip', P') obtained through direct measurements. FIG. 10A also discloses an electric power/current peak curve 1010 obtained by interpolating a higher number of points obtained by directly measuring the delivered electric power for a higher number of peak current values (and thus by employing a higher amount of time). As can be seen in the diagram illustrated in FIG. 10B, the expected error resulting from exploiting the quadratic function 1000 instead of the curve 1010 is higher for the peak current values (and for the electric power values) which are far from the measured point (Ip', P'). In this case, only the time corresponding to two half-waves 310(*i*) of the envelope 300 are required: a first half-wave 310(*i*) for the generation of the normalised current peak/actuation frequency relation NCFR, and a second half-wave 310(*i*) for the generation of the electric power/current peak relation PCR.

According to a further embodiment of the present invention, after that the actuation frequency selection procedure is carried out at least once, a following iteration of the procedure may be performed by advantageously exploiting the pair of values formed by the peak current Ip* identified in the previous iteration and the corresponding electric power value Pt—which corresponds to the electric power that is being actually delivered—as one of the measured point(s) (Ip', P'), (Ip", P"), . . . required to generate the electric power/current peak relation PCR, thus reducing the number of half-waves 310(*i*) of the envelope 300 required to carry out said actuation frequency selection procedure iteration.

Moreover, according to another embodiment of the present invention, if a generic time interval tj during which the actuation frequency Fa is set to a corresponding actuation frequency value TFa(j) is sufficiently long to comprise a plurality of induction heating coil current Ic oscillations, the set of (at least two) positive and negative peaks corresponding to such time interval tj are stored and, after the normalisation, the corresponding set of normalised peaks corresponding to such time interval tj is used to generate a corresponding single averaged normalised peak value.

The previously described actuation frequency selection procedure has been described by making reference to a single induction coil 135 at a time. However, there can be various application scenarios in which two or more induction coils 135 should be activated and controlled together for heating a same load. For example, in the ironing system 100 illustrated in FIG. 1A, the clothes iron 110 may be positioned in such a way that the plate 125 thereof is above two different induction coils 135. Making instead reference to the induction cooking system 100' illustrated in FIG. 1B, a composite cooking zone 190 corresponding to the sum of two or more single cooking zones 170 may be defined by concurrently activating and controlling two or more adjacent induction coils 135 to provide heat to a large cooking pan 180 positioned in such a way to be above the induction coils 135 forming such composite cooking zone 190.

In the following of the description there will be described how an induction heating system such as the ironing system 100 or the induction cooking system 100' can be operated to simultaneously control a group of two or more induction coils 135 according to an embodiment of the present invention.

According to an embodiment of the present invention, in order to jointly activate and control a group of induction coils 135(*k*) (k=1, 2, the control unit 160 carries out the following operations.

Figure 11A:
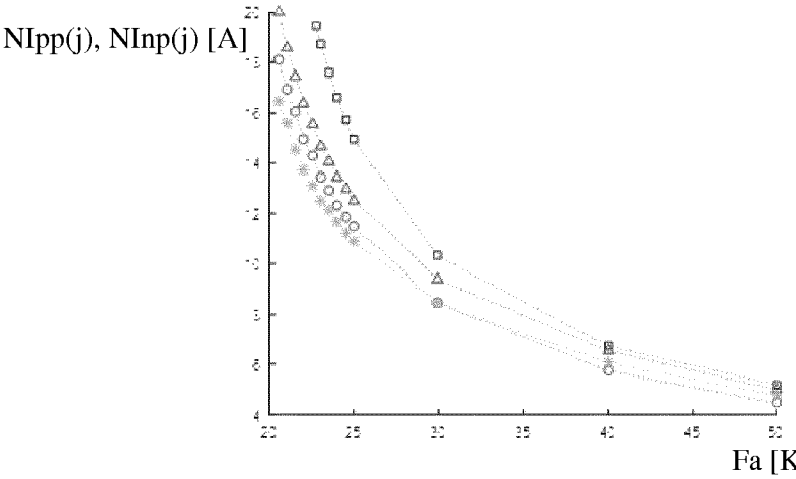
FIG. 11A illustrates four exemplary normalised current peak/actuation frequency relations each one obtained from measures carried out on a respective induction coil.

For each induction coil 135(*k*) of the group, the control unit 160 carries out the operations previously described for calculating a corresponding normalised current peak/actuation frequency relation NCFR(k). FIG. 11A illustrates four exemplary normalised current peak/actuation frequency relations NCFR(k) (k=1, 2, 3, 4) each one obtained from measures carried out on a respective induction coil 135(*k*) (k=1, 2, 3, 4) of the group.

Figure 11B:
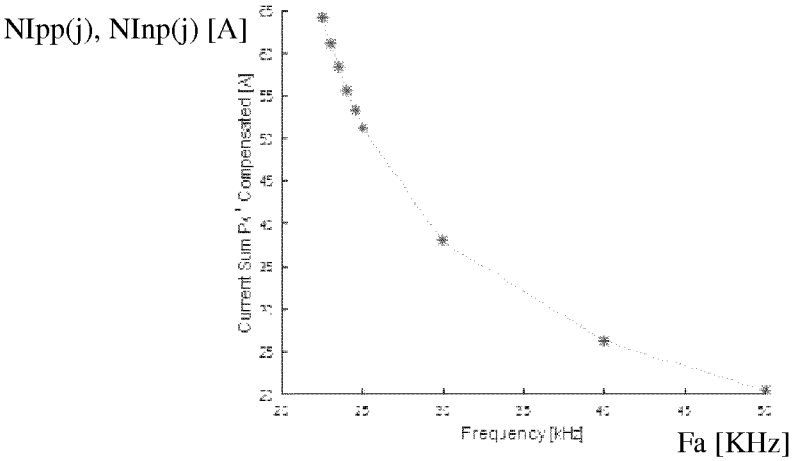
FIG. 11B illustrates a global normalised current peak/actuation frequency relation corresponding to the sum of the four normalised current peak/actuation frequency relations of FIG. 11A.

The control unit 160 combines, e.g. sums to each other the normalised current peak/actuation frequency relations NCFR(k) corresponding to the induction coils 135(*k*) of the group in order to obtain a corresponding global normalised current peak/actuation frequency relation NCFRg expressing the relation occurring between the sum of the normalised positive and negative peaks NIpp(j), NInp(j) of the various induction coils 135(*k*) of the group, and the actuation frequency Fa. An example of such global normalised current peak/actuation frequency relation NCFRg corresponding to the four exemplary normalised current peak/actuation frequency relations NCFR(k) (k=1, 2, 3, 4) of FIG. 11A is illustrated in FIG. 11B.

At this point, all the induction coils 135(*k*) of the group are concurrently activated with the actuation frequency Fa that is set to a same first actuation frequency value Tfa' (such as for example 50 Hz) for the entire duration of a subsequent half wave 310(*i*) of the envelope 300. For each induction coil 135(*k*), the control unit 160 measures the corresponding amount of delivered electric power P(k)' corresponding to said first actuation frequency value Tfa', for example, by directly measuring the peak current Ip(k)' and voltage V(k)' corresponding to said induction coil 135(*k*) during said half wave 310(*i*) of the envelope 300, as previously described in relation with the controlling of a single induction coil.

Then, the control unit 160 sums to each other the measured amounts of delivered electric power P(k)' at said first actuation frequency value Tfa' to obtain a first global amount of delivered electric power Pg' expressing the amount of electric power delivered by considering all the induction coils 135(*k*) of the group when controlled at first actuation frequency value Tfa'. The control unit 160 sums to each other also the measured peak currents Ip(k)' at said first actuation frequency value Tfa' to obtain a first global peak current Ipg' expressing the amount of peak current delivered by considering all the induction coils 135(*k*) of the group when controlled at said first actuation frequency value Tfa'.

Then, the same operations are carried out by concurrently activating all the induction coils 135(*k*) of the group with the actuation frequency Fa that is set to a same second actuation frequency value Tfa" (e.g., corresponding to a minimum allowable frequency or to a minimum allowable frequency plus a threshold) for the entire duration of a subsequent half wave 310(*i*) of the envelope 300. For each induction coil 135(*k*), the control unit 160 measures the corresponding amount of delivered electric power P(k)" corresponding to said second actuation frequency value Tfa", for example, by directly measuring the peak current Ip(k)" and voltage V(k)" corresponding to said induction coil 135(*k*) during said half wave 310(*i*) of the envelope 300. Then, the control unit 160 sums to each other the measured amounts of delivered electric power P(k)" at said second actuation frequency value Tfa" to obtain a second global amount of delivered electric power Pg" expressing the amount of electric power delivered by considering all the induction coils 135(*k*) of the group when controlled at said second actuation frequency value Tfa". The control unit 160 sums to each other also the measured peak currents Ip(k)" at said second actuation frequency value Tfa" to obtain a second global peak current Tpg" expressing the amount of peak current delivered by considering all the induction coils 135(*k*) of the group when controlled at said second actuation frequency value Tfa".

The two global measured pairs (Ipg', Pg'), (Tpg", Pg") are then exploited by the control unit 160 to generate a global electric power/current peak PCRg relation expressing how the electric power delivered to the group of induction coils 135(*k*) varies as a function of the current peak of the AC current flowing in the induction coils 135(*k*) of the coils. The global electric power/current peak PCRg relation is generated in the same way as previously described in relation to a single induction coil 135(*k*) by exploiting the two global measured pairs (Ipg', Pg'), (Ipg", Pg") as if it were measured pairs (Ip', P'), (Ip", P") pertaining to a single coil 135.

At this point, the control unit 160 is configured to assess the value Fa* of the actuation frequency Fa to be set for delivering to the induction coils 135(*k*) of the group an amount of electric power corresponding to an electric power Pt requested by the user as if such induction coils 135(*k*) were a single induction coil by exploiting the global normalized current peak/actuation frequency relation NCFRg and the global electric power/current peak PCRg relation, as previously described when a single induction coil 135 only was considered.

According to an embodiment of the invention, the power delivery to the load is carried out by the control unit 160 by driving all the induction coils 135(*k*) of the group by setting the actuation frequency Fa to the assessed value Fa*.

Thanks to this solution, the control unit 160 is allowed to easily activate and deliver a desired amount of electric power to a plurality of induction coils in a very short time.

According to an embodiment of the present invention, the operations pertaining to the calculation of the normalised current peak/actuation frequency relation NCFR(k) are carried out by the control unit 160 concurrently for all induction coils 135(*k*) of the group (in a same half-wave 310(*i*) of the envelope 300). The same sequence of actuation frequency values TFa(j) is employed for all the induction coils 135(*k*) of the group, or alternatively each induction coil 135(*k*) of the group may be driven by exploiting a respective sequence of actuation frequency values TFa(j), which is generally different than the ones employed for the other induction coils 135(*k*) of the group.

According to another embodiment of the invention, the operations pertaining to the calculation of the normalised current peak/actuation frequency relation NCFR(k) are sequentially carried out by the control unit 160 for each induction coil 135(*k*) of the group (in sequential half-waves 310(*i*) of the envelope 300). The same sequence of actuation frequency values TFa(j) is employed for all the induction coils 135(*k*) of the group. Alternatively each induction coil 135(*k*) of the group is driven by exploiting a respective sequence of actuation frequency values TFa(j), which is generally different than the ones employed for the other induction coils 135(*k*) of the group. In this latter case, a pre-processing action should be carried out in order to obtain a representation using the same frequency base for all the induction coils 135(*k*) of the group. Moreover, carrying out such operations sequentially, implies some measure discrepancy due to the fact that the magnetic interaction among induction coils 135(*k*) of the group is lost if the induction coils 135(*k*) of the group are singularly activated in a sequence.

Mixed solutions are also contemplated, in which operations pertaining to induction coils 135(*k*) of at least one subgroup of the whole group are carried out concurrently.

It has to be appreciated that in order to concurrently carry out the operations for calculating the normalised current peak/actuation frequency relation NCFR(k), on two or more induction coils 135(*k*) the corresponding request of current should be lower than the maximum allowable current that the respective DClink (not illustrated) of the induction (ironing or cooking) system is capable to provide. For this reason, according to an embodiment of the present invention, all the induction coils 135(*k*) affecting a same DClink should be monitored to stop any request of increasing current if the total requested current is higher than the maximum allowable current provided by the respective DClink. According to an embodiment of the present invention, a way to limit the absorbed current is limiting the frequency decrease.

According to an embodiment of the present invention, if the dynamic of an induction coil 135(*k*) of the group is so small to limit the global performance of the group of induction coils 135(*k*), such induction coil 135(*k*) may be excluded from the activation to increase the power delivered to the other induction coils 135(*k*) of the group.

According to an embodiment of the present invention, the same procedure described above may be in principle used to select different actuation frequencies Fa to be singularly used to the various induction coils 135(*k*) of the group. In this case, beating noise can be generated caused by the interaction between induction coils 135(*k*) working at different frequencies. The beating noise may be avoided if the actuation frequencies Fa used for the various induction coils 135(*k*) are properly spaced to each other.

Naturally, in order to satisfy local and specific requirements, a person skilled in the art may apply to the solution described above many logical and/or physical modifications and alterations.

For example, although for describing the actuation frequency selection procedure according to the embodiments of the present invention reference has been made to an induction ironing system or to an induction cooking system, the concepts of the present invention can be applied as well to any induction heating system, such as an induction water heating system, wherein the the induction heating coil(s) may be installed in a water heater for generating a time-varying magnetic field in order to heat a water tank.

The invention claimed is:

1. A method for managing an induction heating system, the induction heating system comprising:

an electrically conducting load;

an inverter circuit comprising a switching section and a resonant section, the switching section comprising switching devices adapted to generate an AC current from an AC input voltage comprising a plurality of half-waves, and the resonant section comprising an induction heating coil adapted to receive the AC current for generating a corresponding time-varying magnetic field in order to generate heat in the electrically conducting load by inductive coupling, wherein the AC current oscillates at an actuation frequency of the switching devices and has an envelope comprising a plurality of half-waves corresponding to the half-waves of the AC input voltage, and wherein the amount of heat generated in the load depends on the electric power delivered to the load through the induction heating coil, such delivered electric power depending in turn on the frequency of the AC current, the method comprising performing at least once the following sequence of phases a)-g):

a) receiving an indication about a target electric power value to be delivered to the load;

b) varying, within a same half-wave of the envelope, the actuation frequency according to a sequence of actuation frequency values, each actuation frequency value of the sequence being set for a corresponding time interval corresponding to a fraction of the duration of the half-wave of the envelope;

c) for each actuation frequency value of the sequence, calculating a corresponding current peak value based on a corresponding set of at least one absolute value peak assumed by the AC current during the corresponding time interval, so as to generate a corresponding current peak/actuation frequency relation;

d) generating an electric power/current peak relation, said electric power/current peak relation depicting how the delivered electric power varies as a function of the current peak of the AC current;

e) selecting a current peak value corresponding to the target electric power exploiting said electric power/current peak relation;

f) selecting an actuation frequency value corresponding to the selected current peak value exploiting said current peak/actuation frequency relation;

g) setting the actuation frequency based on said selected actuation frequency value.

2. The method of claim 1, wherein said generating an electric power/current peak relation comprises:

identifying at least one electric power/current peak value pair comprising an electric power value and a corresponding current peak value, in which said electric power value of the pair corresponds to an actual electric power delivered to the load at the corresponding current peak value of the same pair;

selecting a function expressing a relation between electric power values and current peak values, wherein said identified at least one electric power/current peak value pair satisfies said function.

3. The method of claim 2, wherein said identifying at least one electric power/current peak value pair comprises exploiting an electric power/current peak value pair comprising the actual electric power delivered to the load corresponding to the actuation frequency which has been set at phase g) of a previous iteration of the sequence of operations a)-g.

4. The method of claim 3, wherein said function is a linear function or a quadratic function.

5. The method of claim 3, wherein said identifying at least one electric power/current peak value pair comprises identifying a first electric power/current peak value pair, said identifying a first electric power/current peak value pair comprising:

setting the actuation frequency to a first actuation frequency value for the duration of a further half-wave of the envelope;

measuring the current peak value corresponding to highest absolute value assumed by the AC current during said further half-wave of the envelope;

measuring the actual electric power delivered to the load at said measured current peak value during said further half-wave of the envelope;

setting said first electric power/current peak value pair based on said current peak value and said actual electric power measured during said further half-wave of the envelope.

6. The method of claim 5, wherein said identifying at least one electric power/current peak value pair further comprises identifying a second electric power/current peak value pair, said identifying a second electric power/current peak value pair comprising:

setting the actuation frequency to a second actuation frequency value different from the first actuation frequency value for the duration of a still further half-wave of the envelope;

measuring the current peak value corresponding to highest absolute value assumed by the AC current during said still further half-wave of the envelope;

measuring the actual electric power delivered to the load at said measured current peak value during said still further half-wave of the envelope;

setting said second electric power/current peak value pair based on said current peak value and said actual electric power measured during said still further half-wave of the envelope.

7. The method of claim 5, wherein said first actuation frequency value is equal to or higher than a resonance frequency of the resonant section.

8. The method of claim 7, wherein said second actuation frequency value is equal to or lower than the highest actuation frequency the switching devices can safely sustain.

9. The method of claim 1, wherein said phase of calculating, for each actuation frequency value of the sequence, the corresponding current peak value comprises normalizing each one of the absolute value peaks of the corresponding set of at least one absolute value peak according to the position of the corresponding time interval with respect to said half-wave to obtain a corresponding set of at least one normalised current peak value, and then calculating the peak value based on the normalised current peak values of the set.

10. The method of claim 9, wherein if said set of at least one absolute value peak comprises at least two absolute value peaks, said calculating the peak value based on the normalised current peak values of the set comprising calculating an average value of said at least two absolute value peaks.

11. The method of claim 1, wherein the induction heating system comprises a group of at least two induction heating coils, the method comprising setting the actuation frequency for each induction heating coil of the group based on said selected actuation frequency value, preferably setting the actuation frequency for each induction heating coil of the group to a same value based on said selected actuation frequency value.

12. The method of claim 11, wherein said generating an electric power/current peak relation comprises:

identifying at least a global electric power/current peak value pair comprising a first global electric power value and a corresponding first global current peak value, in which said first global electric power value of the first pair corresponds to an actual electric power delivered to the load by the induction heating coils of the group when the AC current globally received by the induction heating coils of the group assumes a peak corresponding to said first global current peak value;

selecting a function expressing a relation between electric power values and current peak values, wherein said identified at least one global electric power/current peak value pairs satisfy said function.

13. The method of claim 12, wherein said identifying at least one electric power/current peak value pair comprises exploiting an electric power/current peak value pair comprising the actual electric power delivered to the load corresponding to the actuation frequency which has been set at phase g) of a previous iteration of the sequence of operations a) g).

14. The method of claim 13, wherein said function is a linear function or a quadratic function.

15. The method of claim 12, wherein said identifying a first global electric power/current peak value pair comprises:

concurrently activating all the induction heating coils of the group by setting the actuation frequency to a first actuation frequency value for the duration of a further half-wave of the envelope;

for each induction heating coil of the group, measuring a corresponding first current peak value corresponding to the highest absolute value assumed by the AC current received by said induction heating coil during said further half-wave of the envelope, and measuring a corresponding first electric power delivered to the load by such induction heating coil during said further half-wave of the envelope;

setting said first global current peak value to the sum of said measured first current peak values, and setting said first global electric power value to the sum of said measured first electric powers.

16. The method of claim 15, wherein said first actuation frequency value is equal to or higher than a resonance frequency of the resonant section.

17. The method of claim 16, wherein said second actuation frequency value is equal to or lower than the highest actuation frequency the switching devices can safely sustain.

18. The method of claim 11, wherein said generating an electric power/current peak relation comprises:

identifying at least a global electric power/current peak value pair comprising a first global electric power value and a corresponding first global current peak value, in which said first global electric power value of the first pair corresponds to an actual electric power delivered to the load by the induction heating coils of the group when the AC current globally received by the induction heating coils of the group assumes a peak corresponding to said first global current peak value;

selecting a function expressing a relation between electric power values and current peak values, wherein said identified at least one global electric power/current peak value pairs satisfy said function.

19. The method of claim 11, further comprising identifying a second global electric power/current peak value pair, comprising:

concurrently activating all the induction heating coils of the group by setting the actuation frequency to a second actuation frequency value different from the first actuation frequency value for the duration of a still further half-wave of the envelope;

for each induction heating coil of the group, measuring a corresponding second current peak value corresponding to the highest absolute value assumed by the AC current received by said induction heating coil during said still further half-wave of the envelope, and measuring a corresponding second electric power delivered to the load by such induction heating coil during said still further half-wave of the envelope;

setting said second global current peak value to the sum of said measured second current peak values, and setting said second global electric power value to the sum of said measured second electric powers.

20. The method of claim 1, wherein said phase of calculating, for each actuation frequency value of the sequence, the corresponding current peak value comprises normalizing each one of the absolute value peaks of the corresponding set of at least one absolute value peak according to the position of the corresponding time interval with respect to said half-wave to obtain a corresponding set of at least one normalised current peak value, and then calculating the peak value based on the normalised current peak values of the set.

21. An induction heating system for heating an electrically conducting load, the induction heating system comprising:

an inverter circuit comprising a switching section and a resonant section, the switching section comprising switching devices adapted to generate an AC current from an AC input voltage comprising a plurality of half-waves, and the resonant section comprising an induction heating coil adapted to receive the AC current for generating a corresponding time-varying magnetic field in order to generate heat in the electrically conducting load by inductive coupling, wherein the AC current oscillates at an actuation frequency of the switching devices and has an envelope comprising a plurality of half-waves corresponding to the half-waves of the AC input voltage and wherein the amount of heat generated in the load depends on the frequency of the AC current, a control unit configured to perform at least once the following sequence of phases a)-g):

a) receiving an indication about a target electric power value to be delivered to the load;

b) varying, within a same half-wave of the envelope, the actuation frequency according to a sequence of actuation frequency values, each actuation frequency value of the sequence being set for a corresponding time interval corresponding to a fraction of the duration of the half-wave of the envelope;

c) for each actuation frequency value of the sequence, calculating a corresponding current peak value based on a corresponding set of at least one absolute value peak assumed by the AC current during the corresponding time interval, so as to generate a corresponding current peak/actuation frequency relation;

d) generating an electric power/current peak relation, said electric power/current peak relation depicting how the delivered electric power varies as a function of the current peak of the AC current;

e) selecting a current peak value corresponding to the target electric power exploiting said electric power/current peak relation;

f) selecting an actuation frequency value corresponding to the selected current peak value exploiting said current peak relation/actuation frequency;

g) setting the actuation frequency based on said selected actuation frequency value.

22. The induction heating system of claim 21, wherein said inverter circuit is a selected one among:

a half-bridge inverter circuit;

a full-bridge inverter circuit, and a quasi-resonant inverter circuit.

23. The induction heating system of claim 21, wherein:

said electrically conducting load is a plate of a clothes iron and said induction heating coil is mounted on an ironing board, or said electrically conducting load is a portion of a cooking pan, and said induction heating coil is mounted in a cooking hob, or said electrically conducting load is a tank of a water heater, and said induction heating coil is mounted in a water heater.

* * * * *